US007136603B2

(12) United States Patent
Kawai

(10) Patent No.: US 7,136,603 B2
(45) Date of Patent: Nov. 14, 2006

(54) DEVELOPING UNIT AND IMAGE FORMING DEVICE HAVING THE DEVELOPING UNIT

(75) Inventor: Hideaki Kawai, Mukoh (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 206 days.

(21) Appl. No.: 10/911,420

(22) Filed: Aug. 3, 2004

(65) Prior Publication Data

US 2005/0047814 A1 Mar. 3, 2005

(30) Foreign Application Priority Data

Aug. 25, 2003 (JP) ..... 2003-299775

(51) Int. Cl.
*G03G 15/00* (2006.01)
*G03G 15/08* (2006.01)

(52) U.S. Cl. ..... 399/90; 399/119; 399/258

(58) Field of Classification Search ..... 399/90, 399/120, 258
See application file for complete search history.

(56) References Cited

U.S. PATENT DOCUMENTS 5,521,693 A * 5/1996 Kojima et al. ..... 399/90 X
5,581,325 A * 12/1996 Tsuda et al. ..... 399/90 X
6,144,820 A * 11/2000 Ishii et al. ..... 399/90
6,343,192 B1 * 1/2002 Miyabe et al. ..... 399/119 X
6,766,132 B1 * 7/2004 Sakai et al. ..... 399/119 X
6,804,475 B1 * 10/2004 Oguma et al. ..... 399/119 X
6,859,627 B1 * 2/2005 Karakama et al. ..... 399/27
2003/0142991 A1 * 7/2003 Arimitsu et al. ..... 399/90
2003/0161644 A1 * 8/2003 Yokoi et al. ..... 399/90 X
2005/0191079 A1 * 9/2005 Yokoi et al. ..... 399/90

FOREIGN PATENT DOCUMENTS

| | | |
|---|---|---|
| JP | 06-083180 | 3/1994 |
| JP | 11-073010 | 3/1999 |
| JP | 2000-075647 | 3/2000 |
| JP | 2001-249509 | 9/2001 |
| JP | 2002-099145 | 4/2002 |
| JP | 2002-162827 | 6/2002 |
| JP | 2003-173085 | 6/2003 |
| JP | 2003-215894 | 7/2003 |

* cited by examiner

*Primary Examiner*—Sophia S. Chen
(74) *Attorney, Agent, or Firm*—Hogan & Hartson LLP

(57) ABSTRACT

A developing unit includes an impressed member to which a voltage is impressed, a contact member which is made of a metal wire rod and urged by an elastic force to make contact with the impressed member and to be connected electrically with the impressed member, and a supporting plate member which supports the contact member at an inner surface side and exposes a part of the contact member as a contact part for an outer connection to an outer surface from an attaching hole.

10 Claims, 34 Drawing Sheets

DEVELOPING UNIT AND IMAGE FORMING DEVICE HAVING THE DEVELOPING UNIT

BACKGROUND OF THE INVENTION

1. Field of the Invention

The present invention relates to a developing unit used in an image forming device such as a copy machine, a printer and a facsimile machine for adhering a developer on an electrostatic latent image and developing the electrostatic latent image, and to an image forming device having the developing unit.

2. Description of the Related Art

In the above-described image forming device, when developing an electrostatic latent image, a bias voltage is impressed or a voltage is impressed for charging a developer (toner). An electrical wiring becomes necessary for the impressing operation. As an example of such a wiring, according to a first conventional image forming device, a bias electrode consisting of a piano wire, a stainless steel wire for a spring, a phosphor bronze wire or the like is provided on a sleeve flange. One end of the bias electrode is formed in a coil spring shape and makes contact with an electrode plate. According to a second conventional image forming device, a coil spring is used for feeding a bias voltage to developer charging members provided on both end parts of the developer carrier in a longitudinal direction. In case the developing unit can be inserted into or removed from the image forming device, an electrode for an outer connection is provided in a developing unit for feeding the voltage from the image forming device. Conventionally, an electrode consisting of a leaf spring is used.

By the wiring structure processed into the coil spring shape used in the first conventional image forming device, an attaching method is difficult. According to the second conventional image forming device, a structure for inserting in the coil spring becomes necessary, and a place where the coil spring can be used becomes limited. In addition, a sheet metal processing becomes necessary for the electrode structure formed by the leaf spring and the manufacturing costs increase.

SUMMARY OF THE INVENTION

According to an aspect of the present invention, a developing unit includes an impressed member to which a voltage is impressed, a contact member and a supporting plate member. The contact member is made of a metal wire rod and urged by an elastic force to make contact with the impressed member and to be connected electrically with the impressed member. The supporting plate member supports the contact member at an inner surface side and exposes a part of the contact member as a contact part for an outer connection to an outer surface from an attaching hole.

The contact member is preferable to be pressed by the impressed member and applied with an elastic force. Furthermore, one end part of the contact member is preferable to be formed in a coil spring shape and by pressing the one end part against the impressed member, the elastic force is applied to the contact member. A groove is preferable to be formed along the contact member on the inner surface of the supporting plate member, and the contact member is preferably to be fit in the groove.

An image forming device according to the present invention is an image forming device in which the above-described developing unit is inserted removably. The image forming device includes an electrode which is connected to the contact part and supplies the voltage.

By the above-described configuration, since a wiring structure can be formed only by the wire rod in the developing unit, the wiring structure has an extremely simple structure and does not take up space. That is, if the wire rod is bent appropriately and disposed in a vacant space, the space can be utilized more efficiently and the device can be downsized. In addition, by changing the attaching hole of the supporting plate member, a contact position for the outer connection can be changed easily, and the device can be designed more freely. Such a change can be dealt with easily by adjusting the length of the wire rod. By the elastic force of the wire rod, the contact member is connected electrically with the impressed member. A part of the wire rod is exposed as the contact part from the attaching hole of the supporting member. Therefore, the supporting plate member can be attached easily. That is, the supporting plate member can be attached by bending the wire rod, and a sheet metal processing is not necessary to be carried out as in the case of the leaf spring.

Furthermore, when attaching the supporting plate member, if the contact member is set to be pressed by the impressed member, an electrical connection can be made easily. In addition, by forming one end part of the contact member in the coil spring shape, the electrical connection can be made reliable and stable. Moreover, by forming the groove on the inner surface of the supporting plate member and fitting the contact member in the groove, the contact member can be supported in a stable manner.

DETAILED DESCRIPTION OF THE PREFERRED EMBODIMENTS

An embodiment of the present invention will be described. The embodiment to be described below is a preferable specific example for implementing the present invention. Therefore, there are various technical limitations in the description. However, unless explicitly stated in the flowing description to limit the present invention, the present invention shall not be limited to the embodiments.

(Entire Structure of an Image Forming Device)

Figure 1:
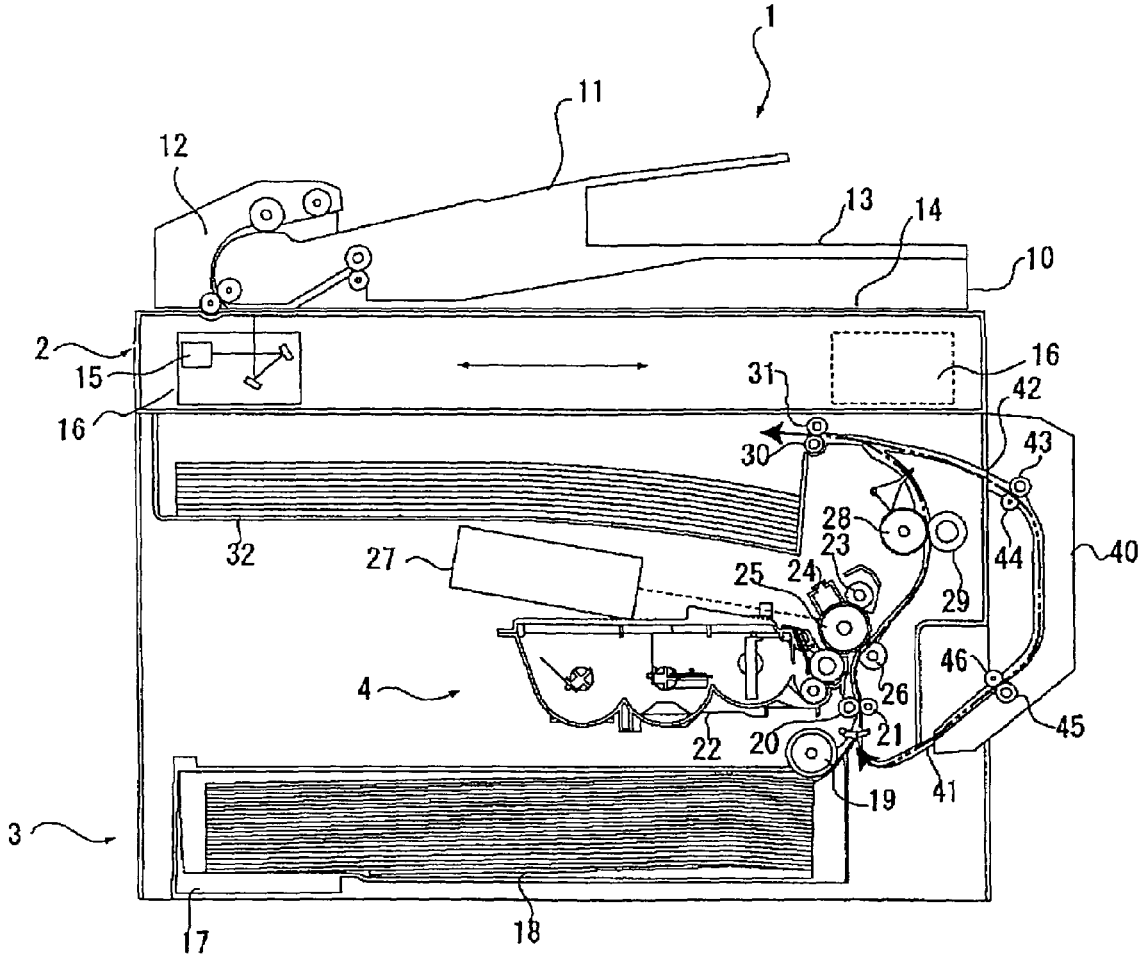
FIG. 1 is a schematic cross-sectional view of the entire image forming device according to an embodiment of the present invention.

FIG. 1 is a schematic cross-sectional view of the entire image forming device according to an embodiment of the present invention. In an upper part of an image forming device 1, a document scanning unit 2 is disposed. In a lower part of the image forming device 1, a paper feed unit 3 and a printing unit 4 are disposed in this order from a bottom surface.

In the document scanning unit 2, an original document placed on a document tray 11 is transported to a scanning position by a document transportation device 12 and discharged onto a document discharge tray 13. Further, the document tray 11 is provided on a document cover 10. A scanning device 16 is disposed to face the original document at the scanning position. The scanning device 16 includes a reading device 15 which scans an original document optically. When scanning a book or the like, the document cover 10 is swung upward and a part of the book or the like to be scanned is placed on a flatbed platen 14. Then, the scanning device 16 is moved in a direction shown with the arrow in the drawing and a scanning operation is carried out. The above-described configuration is the same as a conventional document scanning device known as an Auto Document Feeder (ADF) and a flat bed type.

In the paper feed unit 3, a paper feed cassette 17 is provided and a plurality of papers of a prescribed size are stacked on a flapper 18. A pickup roller 19 is provided at a right end of the paper feed cassette 17. The flapper 18 is urged upward by a spring member (not shown) so that an upper surface of the stacked papers makes contact with the pickup roller 19. Under this state, when the pickup roller 19 is driven and rotated, the papers are fed one sheet at a time into a paper transportation path by a frictional force.

The fed paper is transported to the printing unit 4 by a feed roller 20 and a press roller 21. For printing onto the transported paper, the printing unit 4 includes a developing unit 22, a paper dust removing roller 23, a corona charger 24, a photoconductive drum 25, a transfer roller 26, an exposure head 27 and a fuser roller 28. The paper dust removing roller 23 is formed of an electrically conductive sponge or the like. The paper dust removing roller 23 traps toner or paper dust adhered on a surface of the photoconductive drum 25 after a transfer process. The corona charger 24 uniformly charges the surface of the photoconductive drum 25 by a discharge from a corotron. By exposing the photoconductive drum 25 by the exposure head 27 according to an image printing signal, an electrostatic latent image is formed on the photoconductive drum 25, which is charged uniformly by the paper dust removing roller 23 and the corona charger 24. Then, although details will be described later, the toner in the developing unit 22 is transferred onto the electrostatic latent image formed on the photoconductive drum 25, and the electrostatic latent image is visualized. The transfer roller 26 is disposed at a position facing the photoconductive drum 25 across the paper. When a prescribed voltage is impressed, a toner image formed on the surface of the photoconductive drum 25 is transferred onto the paper. Then, the transferred toner image is nipped and heat-pressed by the fuser roller 28 and a press roller 29 to be fixed onto the paper. The fixed paper is nipped between a paper discharge roller 30 and a press roller 31 and transported out onto a paper discharge tray 32.

In FIG. 1, the paper transportation path is shown with dashed lines between the paper feed unit 3 and the paper discharge tray 32. A transportation roller and a paper guide disposed along the paper transportation path constitute a paper transportation unit.

A reverse transportation unit 40 is inserted removably at a side surface of the image forming device 1. At the side surface where the reverse transportation unit 40 is inserted, a paper transportation outlet 41 and a paper transportation inlet 42 are formed. In the paper transportation unit 40, two pairs of transportation rollers, i.e. a feed roller 43 and a press roller 44, and a feed roller 45 and a press roller 46, are disposed vertically. The reverse transportation path shown with double dashed lines in FIG. 1 is formed to diverge from the paper transportation path between the paper discharge roller 30 and the fuser roller 28, to pass between the two pairs of the transportation rollers 43 and 44 and 45 and 46 and to join the paper transportation path between the roller pairs 20 and 21 and the pickup roller 19.

When printing onto both sides of the paper, the paper is transported through the paper transportation path shown with the dashed lines in FIG. 1 and a printing process is executed on one side of the paper. Then, the paper is transported out onto the paper discharge tray 32 by the paper discharge roller 30. Under a state in which a trailing edge of the paper is nipped by the paper discharge roller 30 and the press roller 31, the transportation operation is stopped once. Then, the paper discharge roller 30 is driven to rotate in a reverse direction, and the paper is transported into the reverse transportation path from the trailing edge. The paper is nipped by the feed roller 43 and the press roller 44 and transported through the reverse transportation path. Next, the paper is nipped by the feed roller 45 and the press roller 46 and transported further so that the paper makes contact with the roller pairs 20 and 21. When the paper is transported through the paper transportation path under this state, another side of the paper faces the photoconductive drum 25 and the printing process is executed on the other side of the paper. Accordingly, both sides of the paper are printed.

(Entire Structure of the Printing Unit)

Figure 2:
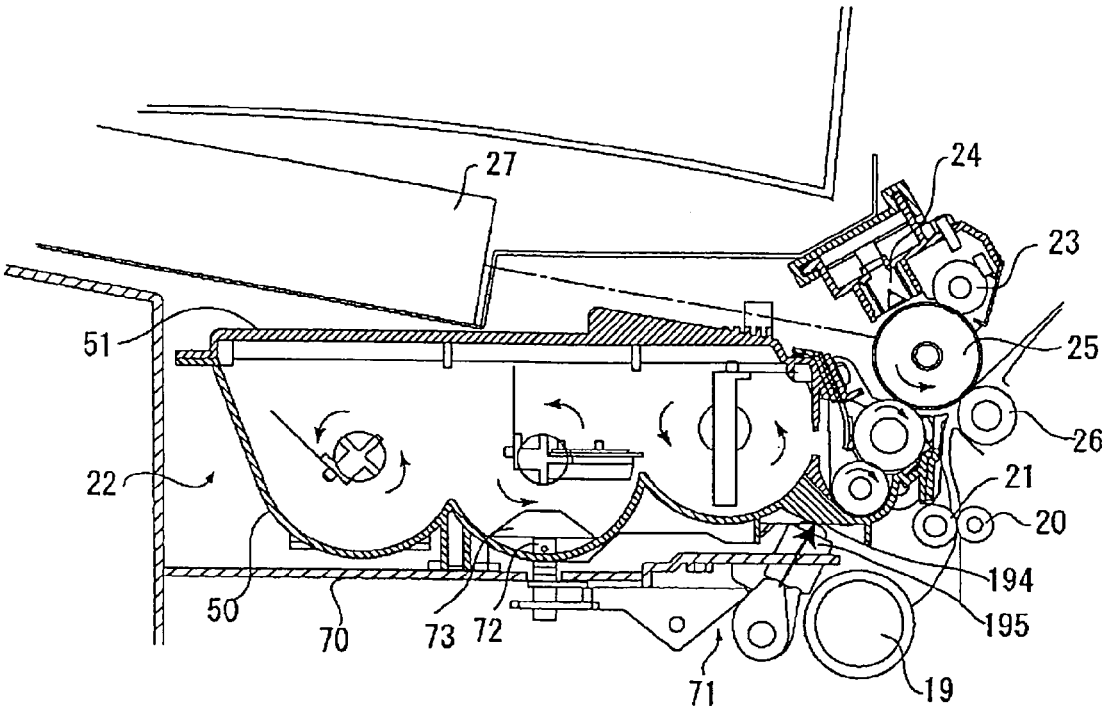
FIG. 2 is an enlarged cross-sectional view showing a printing unit.
Figure 3:
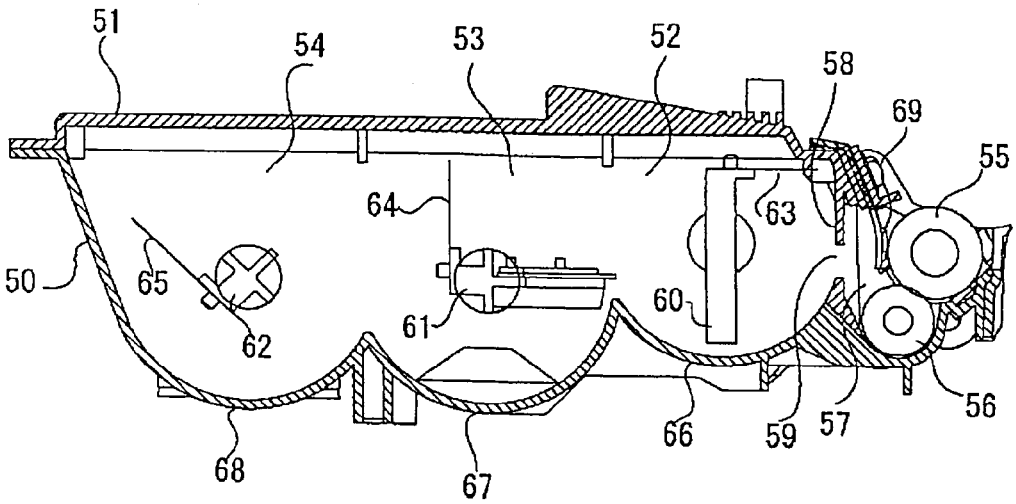
FIG. 3 is an enlarged cross-sectional view showing a developing unit.

FIG. 2 is an enlarged cross-sectional view showing the printing unit 3 in FIG. 1. FIG. 3 is an enlarged cross-sectional view showing the developing unit 22. As described above, the developing unit 22, the paper dust removing roller 23, the corona charger 24 and the transfer roller 26 are disposed around the photoconductive drum 25. At a gap between the corona charger 24 and the developing unit 22, a laser light from the exposure head 27 is irradiated on the surface of the photoconductive drum 25 according to the image printing signal.

(Entire Structure of the Developing Unit)

The developing unit 22 is formed by an upper part of a container 50 being sealed with a cover 51. Three toner chambers 52, 53 and 54 are formed as toner replenish chambers in the container 50. At a region of the container 50 located on the photoconductive drum 25, a supply chamber 57 having a developing roller 55 and a supply roller 56 is formed. The first toner chamber 52 and the supply chamber 57 are partitioned by a partition plate 58 that extends from a lower surface of the cover 51. A replenish opening 59 is formed through the partition plate 58.

As shown in FIG. 3, the three toner chambers 52, 53 and 54 are disposed to be in parallel with one another in a horizontal direction under a state in which the developing unit 22 is inserted in the image forming device 1. At approximately the center of each of the toner chambers, paddles 60, 61 and 62 are provided as a means for agitating and transferring. Suppose that a perpendicular direction of the page of FIG. 2 is in a front-back direction of the developing unit 22. Then, both end parts of a rotational shaft of each of the paddles in the front-back direction are supported by front and back frames of the container 50. The rotational shafts are aligned in the front-back direction. At a tip end of the paddle 60, a blade 63 made of a flexible resin film is attached along a rotational direction of the paddle 60. In the same manner, a blade 64 is attached to the paddle 61 and a blade 65 is attached to the paddle 62. A common member is used for the blades 63, 64 and 65. Sliding surfaces 66, 67 and 68 are formed on a bottom surface of the container 50. The sliding surfaces 66, 67 and 68 are curved outward to have an arc-shape in cross-section so as to follow along a path of rotational movements of the blades attached to the paddles.

The toner replenished in each of the toner chambers 52, 53 and 54 is accumulated on the sliding surfaces 66, 67 and 68. When the paddles 60, 61 and 62 are rotated, the blades 63, 64 and 65 are rotated to slide against the sliding surfaces 66, 67 and 68, respectively. In the sliding movement of each of the blades, the toner is scooped and the toner is agitated in each of the toner chambers. As a result, the deterioration of the toner due to aggregation of the toner can be prevented. Moreover, as shown in FIG. 2, when the blades 63, 64 and 65 are rotated counterclockwise, the toner in the third toner chamber 54 is transferred into the second toner chamber 53, and the toner in the second toner chamber 53 is transferred into the first toner chamber 52. Then, the toner in the first toner chamber 52 is replenished into the supply chamber 57 through the replenish opening 59 of the partition plate 58. At this time, the replenished toner is agitated by the paddle 60 in the first toner chamber 52 and a preliminary charging is carried out. The replenish opening 59 is opened as a slit in the front-back direction. By adjusting the width and the position of the opening, the amount of the toner replenished from the first toner chamber 52 into the supply chamber 57 can be adjusted.

While the supply roller 56 is rotated, the supply roller 56 is rubbed against the developing roller 55, and the toner replenished into the supply chamber 57 is rubbed and charged. Then, the toner is carried on the surface of the developing roller 55. A developing blade 69 is disposed in proximity to the surface of the developing roller 55. The developing blade 69 controls the layer thickness of the supplied toner. By the developing roller 55 and the photoconductive drum 25 being rubbed against one another while rotating, the toner layer controlled to have a prescribed layer thickness by the developing blade 69 is adhered onto the electrostatic latent image formed on the surface of the photoconductive drum 25, and the electrostatic latent image is developed.

The developing unit 22 can be inserted or removed with respect to the image forming device 1 in the front-back direction as to be described later. In FIG. 2, it is defined that a front side in the perpendicular direction of the page is a front side of the developing unit 22 and the opposite is a rear side of the developing unit 22. When inserting the developing unit 22 into the image forming device 1, the developing unit 22 is inserted from the rear side into an installation space formed in a main frame 70 of the image forming device 1. Although a mechanism and an operation for inserting the developing unit 22 will be described in detail later, to describe briefly, after the developing unit 22 is inserted, the container 50 is pushed upward from a lower side by a pressing mechanism 71 provided on the main frame 70 of the image forming device 1. Then, the developing unit 22 is set under a state in which the developing roller 55 makes contact with the photoconductive drum 25. In response to the pressing movement of the pressing mechanism 71, a remaining toner detecting sensor 72 is elevated and set in a concave groove 73. Further, the concave groove 73 is formed of a transparent member and provided in the sliding surface 67.

(Drive Mechanism of the Developing Unit)

Figure 4:
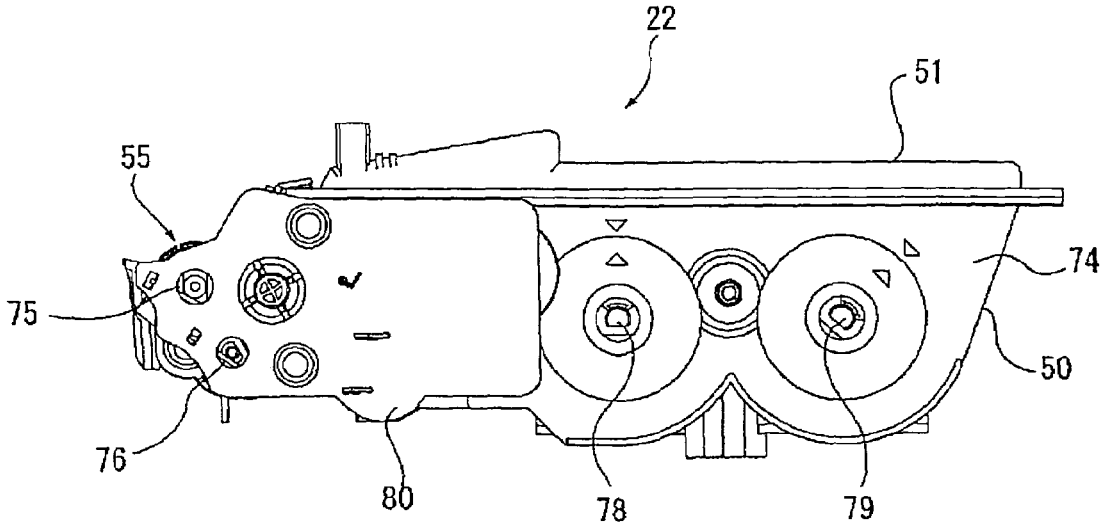
FIG. 4 is an external view showing a rear part of the developing unit.

The developing roller 55, the supply roller 56 and the paddles 60, 61 and 62 are driven and rotated by a drive transfer mechanism. The drive transfer mechanism is connected to a drive source in the image forming device 1 when the developing unit 22 is inserted into the image forming device 1. FIG. 4 is an external view showing the rear side of the developing unit 22. On a rear frame 74 of the container 50, a rotational shaft 75 of the developing roller 55, a rotational shaft 76 of the supply roller 56, a rotational shaft 77 of the paddle 60, a rotational shaft 78 of the paddle 61 and a rotational shaft 79 of the paddle 62 are supported rotatably. An end part of each of the rotational shafts protrudes outward from the rear frame 74. As to be described later, a drive transmitting gear is mounted on each of the protrusions, respectively. A cover member 80 is attached on the rear frame 74 to cover a part of the rear frame 74 located on the developing roller 55 including the rotational shafts 75, 76 and 77.

Figure 5:
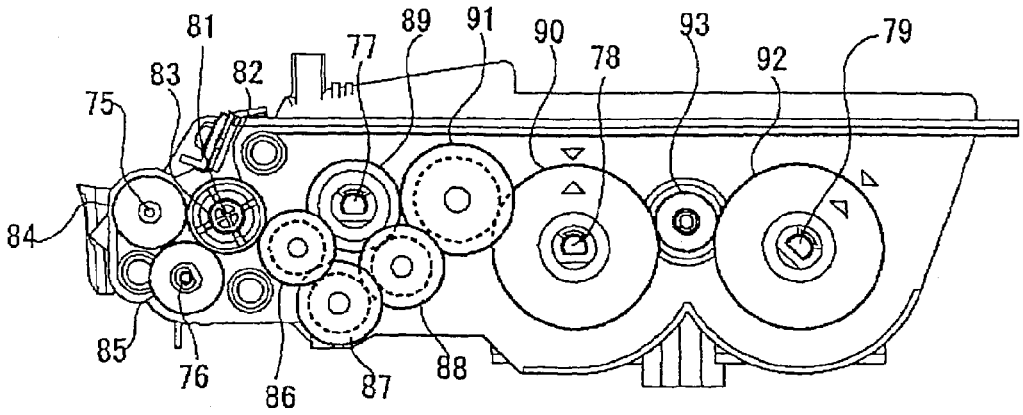
FIG. 5 is an external view showing a state in which a cover member is removed in FIG. 4.
Figure 6:
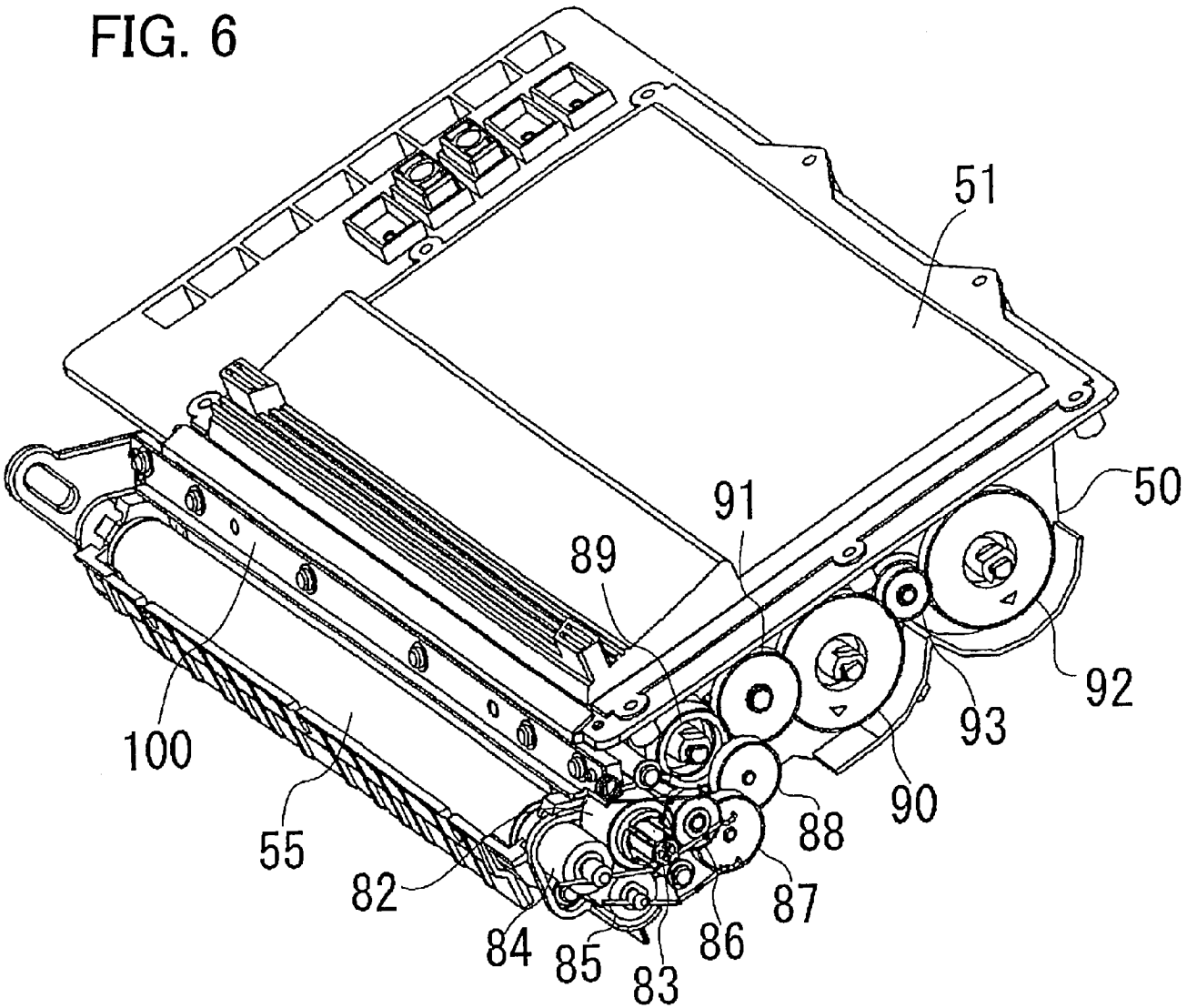
FIG. 6 is an external perspective view of the entire developing unit.

FIG. 5 shows a state in which the cover member 80 is removed in FIG. 4. FIG. 6 is a perspective view of FIG. 5. Referring to FIG. 5 and FIG. 6, a gear transmitting mechanism for driving and rotating each of the rotational shafts will be described. First, a drive shaft 81 is fixed on the rear frame 74 so that an axial direction of the drive shaft 81 becomes parallel with the rotational shaft 75. A tip end of the drive shaft 81 protrudes outward so that the drive shaft 81 can be connected to the drive source in the image forming device 1. A drive gear 82 is mounted rotatably on the drive shaft 81. A connection part 83 is provided integrally on the drive shaft 81 so as to cover the tip end of the drive shaft 81. A plurality of protrusions extending in the axial direction are formed around the connection part 83. The protrusions are fit in connection holes (not shown) of the image forming device 1 to be connected to the drive source in the image forming device 1.

A gear 84 mounted on the rotational shaft 75 and a gear 85 mounted on the rotational shaft 76 of the supply roller 56 are meshed with the drive gear 82. The developing roller 55 and the supply roller 56 are rotated by a rotational drive force transmitted from the gears 84 and 85. An intermediate gear 86 is meshed with the drive gear 82 for transmitting a drive force to each of the paddles. A gear shaft of the intermediate gear 86 is provided in a standing condition on the rear frame 74. The intermediate gear 86 is a two-stage gear in which a pinion (shown with the dashed line in FIG. 5) having a smaller diameter is formed at an inner side and a pitch wheel having a larger diameter is formed at an outer side. The pitch wheel part of the intermediate gear 86 is meshed with the drive gear 82.

Intermediate gears 87 and 88, which are like the intermediate gear 86, are meshed with the intermediate gear 86 sequentially. The intermediate gears 87 and 88 are provided in a standing condition on the rear frame 74 so as to be arranged toward each of the paddles. The pinion part of the intermediate gear 86 is meshed with a pitch wheel part of the intermediate gear 87. A pinion part of the intermediate gear 87 is meshed with a pitch wheel part of the intermediate gear 88. A gear 89 mounted on the rotational shaft 77 of the paddle 60 is meshed with a pinion part of the intermediate gear 88. The three intermediate gears are meshed with one another as described above to form a deceleration mechanism. The paddle 60 is driven and rotated at a rotational speed decelerated from a rotational speed of the drive gear 82.

An intermediate gear 91 is provided between a gear 90 mounted on the rotational shaft 78 of the paddle 61 and the gear 89. The intermediate gear 91 is supported rotatably on a stud provided in a standing condition on the rear frame 74. The intermediate gear 91 is a two-stage gear in which a pinion part having a smaller diameter is formed at an inner side and a pitch wheel part having a larger diameter is formed at an outer side. The pitch wheel part of the intermediate gear 91 is meshed with the gear 89. The pinion part of the intermediate gear 91 is meshed with the gear 90. Therefore, a rotational speed of the gear 89 decelerates and is transmitted by the intermediate gear 91. The paddle 61 is driven and rotated at a rotational speed slower than the paddle 60. An intermediate gear 93 is provided between a gear 92 mounted on the rotational shaft 79 of the paddle 62 and the gear 90. The intermediate gear 93 is supported rotatably on a stud provided in a standing condition on the rear frame 74. The intermediate gear 93 is meshed with the gears 90 and 92. Therefore, the gear 92 rotates at the same rotational speed as the gear 90. Accordingly, the paddles 61 and 62 are driven and rotate in the same rotational direction.

As described above, the paddle 60 is set to rotate at the rotational speed decelerated by the rotational speed of the drive gear 82. In addition, the paddles 61 and 62 are set to rotate at the rotational speed decelerated further by the rotational speed of the paddle 60. Since the rotational speeds of the paddles 60, 61 and 62 are set as described above, the paddle 60 can rotate at a fast rotational speed to some extent to charge the toner sufficiently and then to supply the toner to the supply chamber 57. By rotating the paddles 61 and 62 slowly, the paddles 61 and 62 can agitate and transfer the toner while suppressing the deterioration of the toner due to an excessive agitation. Moreover, although details will be described later, in case of detecting a remaining amount of the toner, the remaining amount can be detected more reliably if the blade of the paddle rotates slowly. The rotational speed of the paddle 60 is set at a preferable value according to a developing process such as a property of the toner and a rotational speed of the developing roller. The rotational speeds of the paddles 61 and 62 are set according to, for example, a degree of the deterioration of the toner or the precision of the detection of the remaining amount of the toner. In the above-described example, the rotational speeds of the paddles 61 and 62 are the same. However, the rotational speed of the paddle 62 can be set slower. In such a case, the intermediate gear 93 can be formed as a two-stage gear like the intermediate gear 91 to decelerate the rotational speed of the paddle 62. The rotational speed of the paddle 60 can decelerate appropriately by adjusting the number of gear teeth of the intermediate gears 86, 87 and 88.

The paddles 61 and 62 are necessary to be positioned at a prescribed rotational position when filling the toner. In other words, the toner is filled from a toner filling opening 94 formed on the front frame of the container 50 at the front side of the developing unit 22. Thus, when filling the toner, if the blade of the paddle is located at a position where the blade of the paddle is exposed to the outside from the toner filling opening 94, the toner cannot be filled in smoothly. Therefore, the rotational position of the paddle is necessary to be positioned so that the blade of the paddle is located at a position away from the toner filling opening 94 when filling the toner.

Figure 7A:
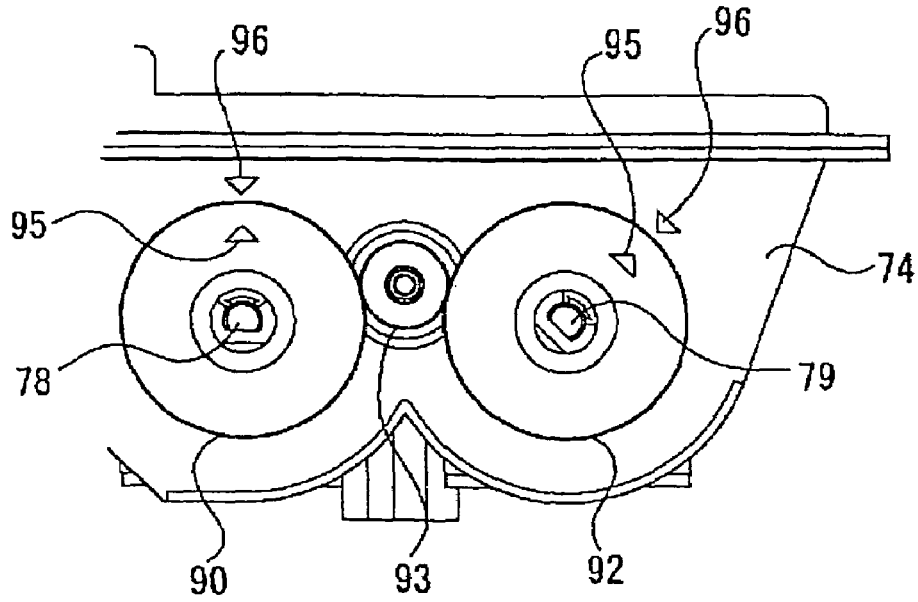
FIG. 7A and FIG. 7B are enlarged views showing paddle parts of FIG. 5.
Figure 7B:
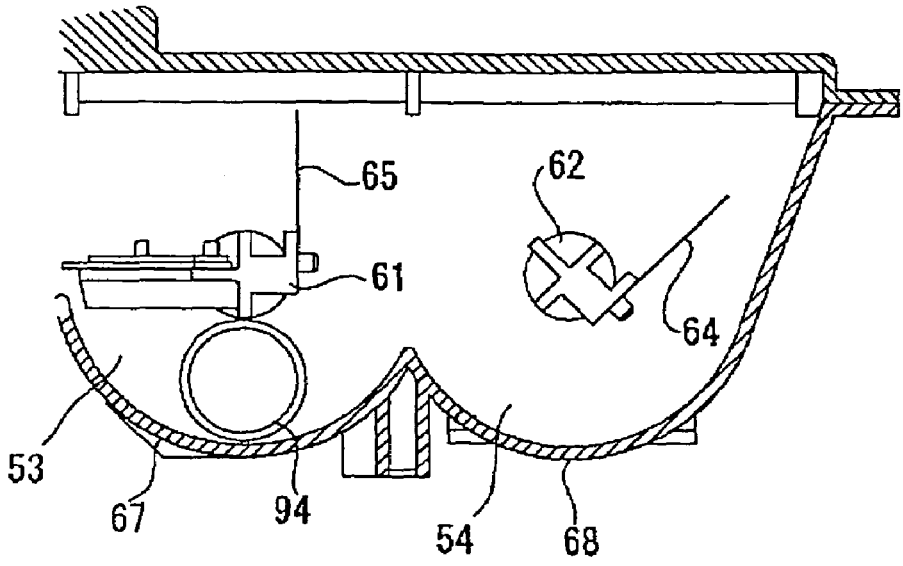

FIG. 7A and FIG. 7B are enlarged views of a drive transmitting part of the paddles 61 and 62 in FIG. 5. FIG. 7A is an external view. FIG. 7B is a cross-sectional view. As shown in FIG. 7B, in this example, the toner filling opening 94 is provided at a lower side of the rotational shaft of the paddle 61 at the front frame of the second toner chamber 53. The rotational position of the paddle 61 is positioned so that the blade 65 of the paddle 61 is located at an upper side and a cleaner for detecting the remaining amount to be described later becomes horizontal. The blade 64 of the paddle 62 of the third toner chamber 54 is also located at an upper side. By positioning the paddles 61 and 62 as described above, the paddles 61 and 62 do not interfere with the filling of the toner from the toner filling opening 94. As a result, the toner can be filled in smoothly.

However, since the paddles 61 and 62 are sealed inside the developing unit 22, the rotational positions of the paddles 61 and 62 cannot be confirmed from the outside. Therefore, triangular indicators 95 are marked in advance on the surfaces of the gears 90 and 92 that rotate integrally with the paddles 61 and 62. Similar indicators 96 are also marked in advance on the rear frame 74. When the gears 90 and 92 are positioned at prescribed rotational positions as shown in FIG. 7B, the indicators 95 and 96 are set at indication positions facing one another. When filling the toner, if the gears 90 and 92 are rotated until the indicators 95 correspond to the indicators 96, the toner can be filled in smoothly without being interfered with by the blades as described above. Moreover, if the indication position and the direction of the indicator 95 are set at the same position as the attached position and the extending direction of the blade, the attached position of the blade can be confirmed easily. As a result, an assembling process can be carried out more efficiently. The indicators 95 and 96 can be formed concavo-convex when forming the gears or the like. If the indicators 95 and 96 can be confirmed by the naked eye, other methods can be adopted.

(Blade Structure of the Developing Roller)

Figure 8:
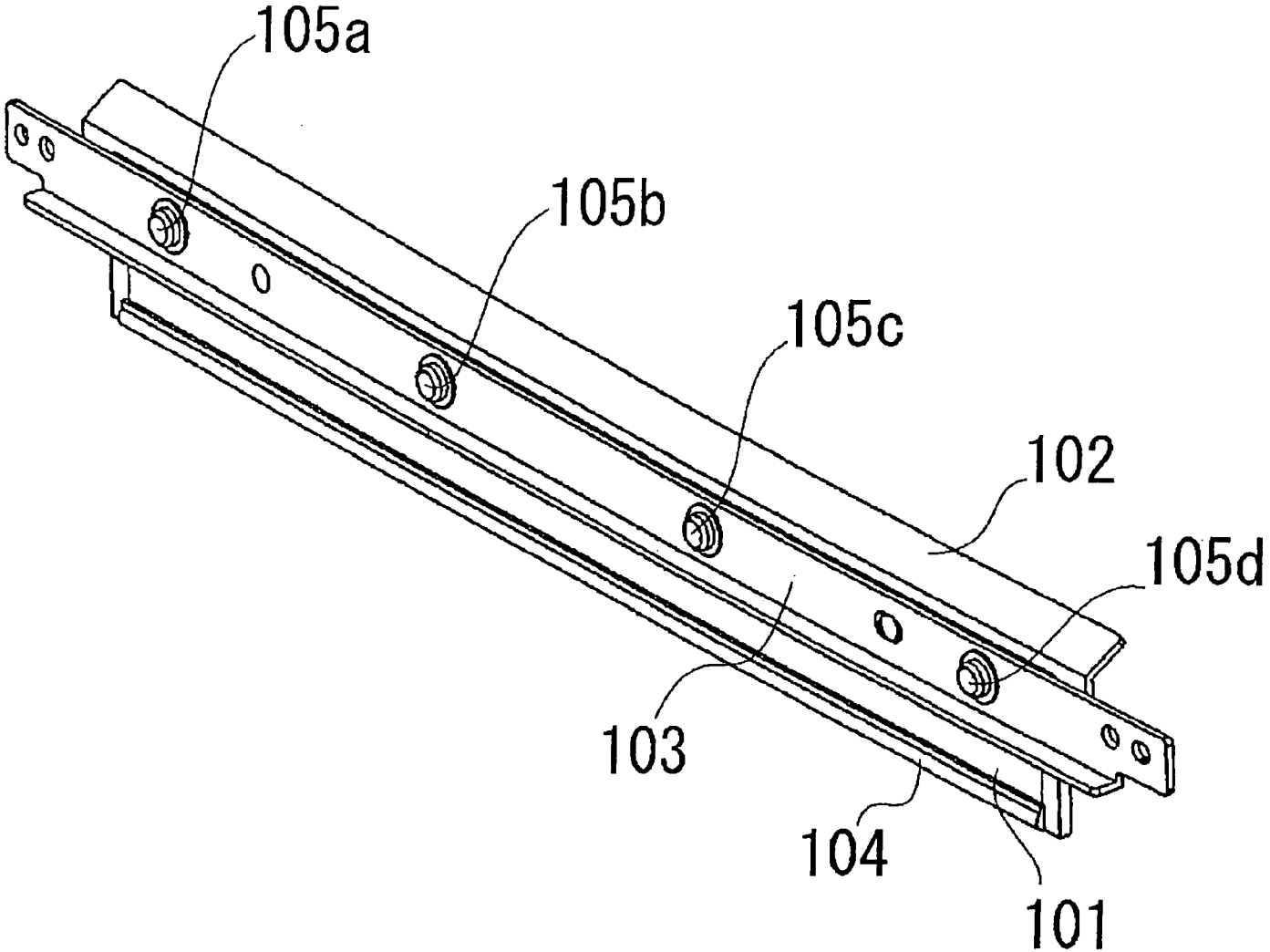
FIG. 8 is a perspective view of a blade part.
Figure 9:
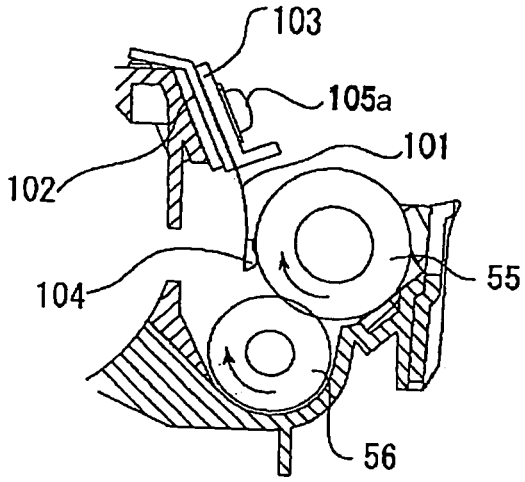
FIG. 9 is a cross-sectional view showing a state in which the blade is making contact with a developing roller.

In FIG. 6, reference numeral 100 denotes a blade which makes contact with the surface of the developing roller 55. FIG. 8 is a perspective view of the blade 100. FIG. 9 is a cross-sectional view showing a state in which the blade 100 is making contact with the developing roller 55. The blade 100 is formed by sandwiching an elastic blade 101 between a supporting plate 102 and a pressing plate 103. Further, the elastic blade 101 makes contact with the surface of the developing roller 55. The elastic blade 101 is formed of a long thin plate extending in an axial direction of the developing roller 55. A rubber member 104 having a narrow width is fixed on an edge of the elastic blade 101 where the developing roller 55 makes contact. Since the long thin plate is formed of a leaf spring member, when the elastic blade 101 is pressed against the developing roller 55, the elastic blade 101 is bent as shown in FIG. 9 and the rubber member 104 makes contact against the surface of the developing roller 55. Under this state, when the developing roller 55 is rotated in a direction shown with the arrow in FIG. 9, the toner supplied to the surface of the developing roller 55 by the supply roller 56 is uniformed into a prescribed layer thickness. A charged level of the toner can be increased by strongly pressing the toner against the developing roller 55 by the blade 100. The supporting plate 102 and the pressing plate 103 are fixed by four screws 105*a* through 105*d* across an edge of the elastic blade 101 located at an opposite side of the edge where the rubber member 104 is fixed.

Figure 10:
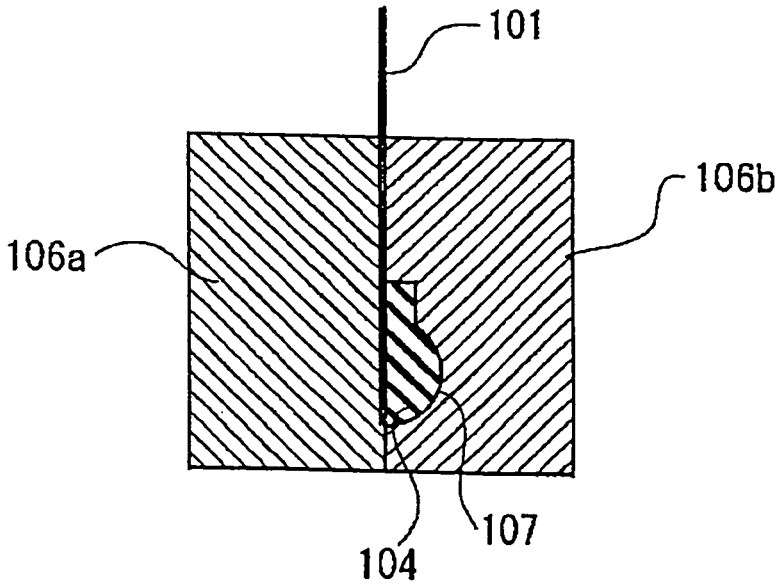
FIG. 10 is an explanatory drawing relating to a manufacturing process of the blade.
Figure 11A:
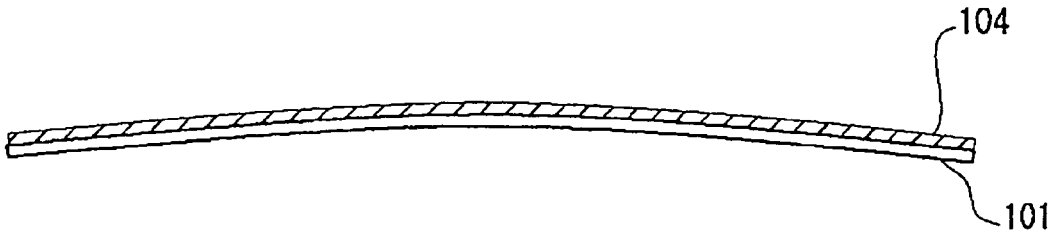
FIGS. 11A–11D are explanatory drawings relating to an adjustment of deformations of the blade.

As shown in FIG. 10, the elastic blade 101, which is a thin plate, is sandwiched between two molds 106*a* and 106*b*. A rubber is inserted and molded in a cavity 107 formed in the mold 106*b* and the rubber member 104 is formed. The elastic blade 101 manufactured in such a manner is prone to be warped as a whole. FIGS. 11A and 11C schematically show states in which the elastic blade 101 is warped. In FIG. 11A, the elastic blade 101 is warped to be curved toward the surface on which the rubber member 104 is fixed. In FIG. 11C, the elastic blade 101 is warped to be curved toward the opposite side.

Figure 11B:
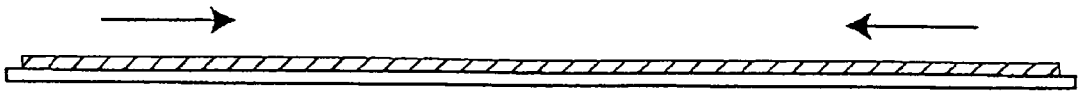
Figure 11C:
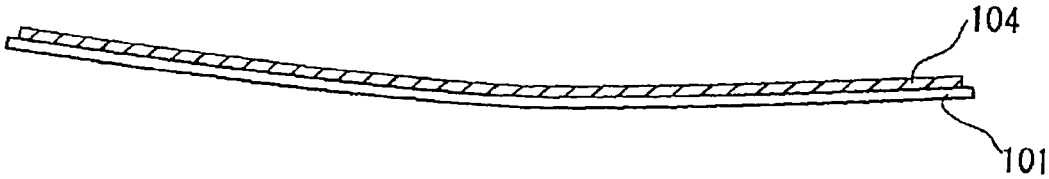

When the elastic blade 101 under the state shown in FIG. 11A is unwarped forcibly into a flat state shown in FIG. 11B, the rubber member 104 receives a force in a direction to be compressed as a whole, as shown with the arrows. When the rubber member 104 receives the force in the direction to be compressed, concavo-convex shapes are generated on the rubber member 104 so that the surface becomes wavy. Under this state, the toner layer having a uniform layer thickness cannot be formed on the surface of the developing roller 55.

Figure 11D:
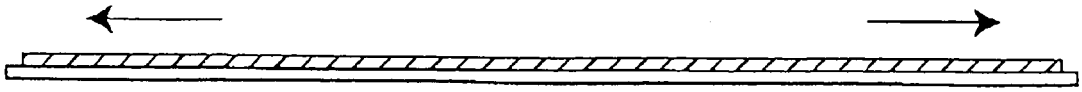

When the elastic blade 101 under the state shown in FIG. 11C is unwarped forcibly into a flat state shown in FIG. 11D, the rubber member 104 receives a force in a direction to be stretched as a whole, as shown with the arrows. When the rubber member 104 receives the force in the direction to be stretched, the above-mentioned wavy phenomenon is not generated.

Figure 12:
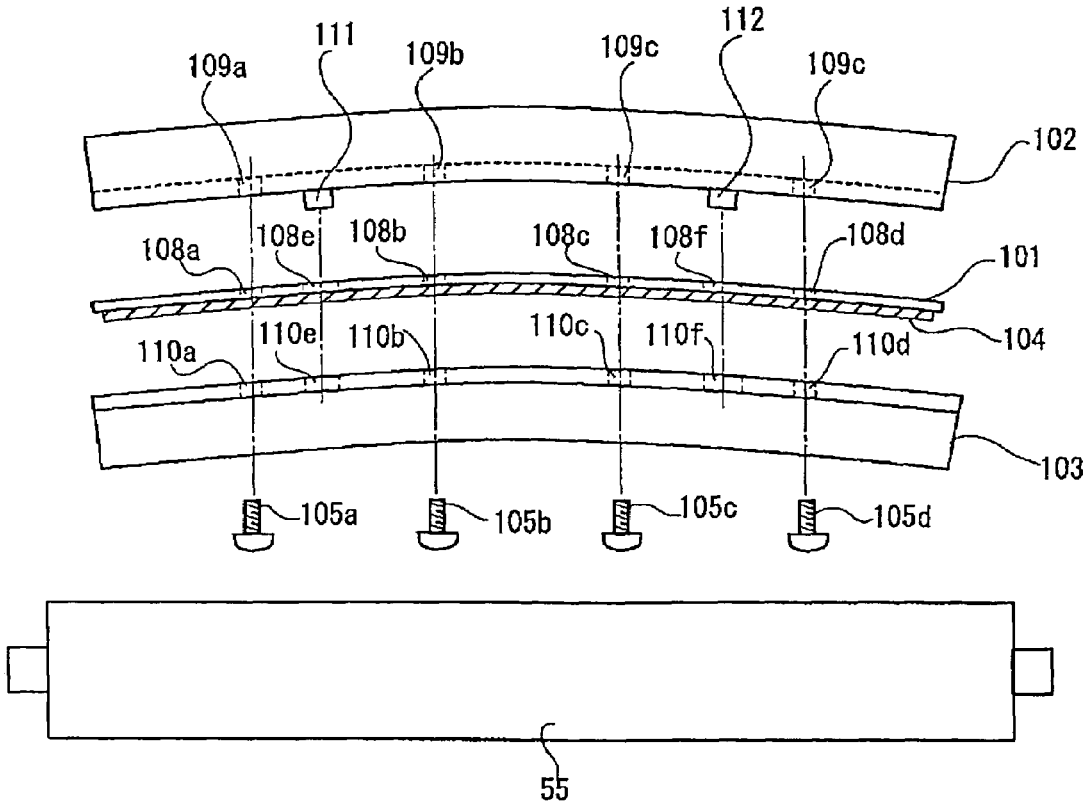
FIG. 12 is an assembly drawing of the blade.

If the elastic blade 101 is set in advance to be curved toward the surface opposite to the surface on which the rubber member 104 is fixed as shown in FIG. 11C, even when the elastic blade 101 is warped, the rubber member 104 can make contact with the developing roller 55 without the wavy phenomenon being generated. Therefore, as shown in FIG. 12, when manufacturing the supporting plate 102 and the pressing plate 103 in the sheet metal processing, the plates 102 and 103 are processed in a manner that the plates 102 and 103 are warped in advance. The plates 102 and 103 are warped so that the center part is located away from the developing roller 55 more than the end parts.

When assembling the blade 100, first, positioning bosses 111 and 112 formed on the supporting plate 102 are respectively fit into a positioning hole 108*e* and an escape hole 108*f* formed on the elastic blade 101. The positioning bosses 111 and 112 are formed in a circular shape. The positioning hole 108*e* is also formed in a circular shape. On the other hand, the escape hole 108*f* is formed in an oval shape to be longer in a longitudinal direction of the elastic blade 101. Therefore, after fitting the positioning boss 111 into the positioning hole 108*e*, even when there is a manufacturing error in a positional relationship between the positioning boss 112 and the escape hole 108*f*, the elastic blade 101 can be mounted accurately onto the supporting plate 102 without any problems. Next, the pressing plate 103 is mounted onto the elastic blade 101. At this time, the positioning bosses 111 and 112 are respectively fit into a positioning hole 110*e* and an escape hole 110*f* of the pressing plate 103. The escape hole 110*f* is also formed in an oval shape like the escape hole 108*f*. Accordingly, the pressing plate 103 can also be mounted accurately onto the supporting plate 102 like the elastic blade 101.

After fitting the elastic blade 101 and the pressing plate 103 on the supporting plate 102, the pressing plate 103, the elastic blade 101 and the supporting plate 102 are fixed by the screws 105*a* through 105*d*. In this case, the screws are tightened and fixed from the one that is located closest to the positioning hole. By tightening and fixing the screws in such an order, even when each member is warped, the elastic blade 101 can be fixed against the warp.

In this example, the screw 105*a* located closest to the positioning hole 108*e* is inserted into a mounting hole 110*a* of the pressing plate 103, a mounting hole 108*a* of the elastic blade 101 and a mounting hole 109*a* of the supporting plate 102. Then, the screw 105*a* is tightened and fixed. Next, the screw 105*b* is inserted into mounting holes 110*b*, 108*b* and 109*b* in the same manner, and is tightened and fixed. The screw 105*c* is inserted into mounting holes 110*c*, 108*c* and 109*c*, and is tightened and fixed. The screw 105*d* is inserted into mounting holes 10*d*, 108*d* and 109*d*, and is tightened and fixed.

Figure 13A:
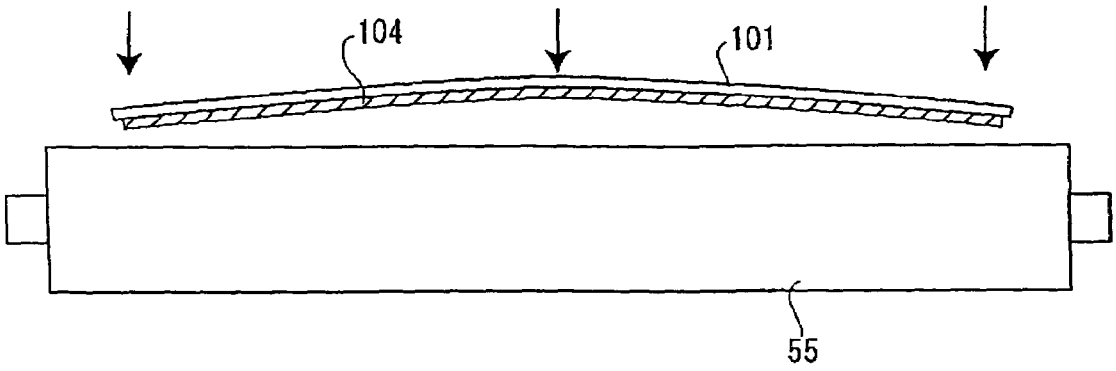
FIG. 13A and FIG. 13B are explanatory drawings showing a state in which the blade is making contact with the developing roller.
Figure 13B:
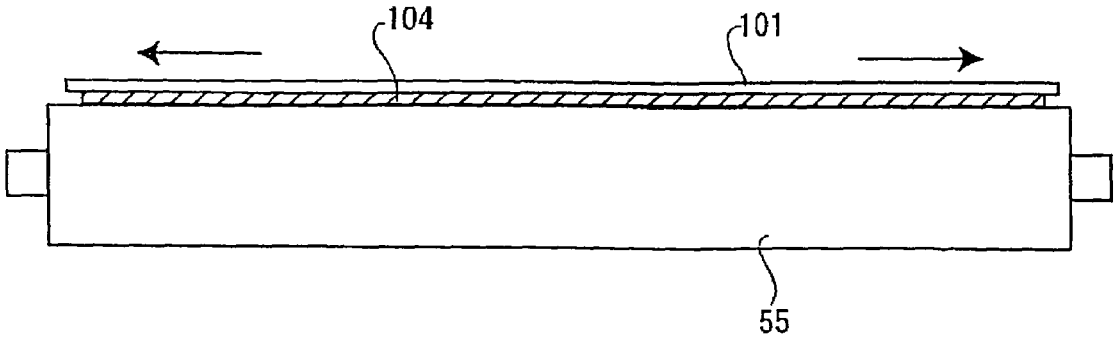

When the screws are tightened and fixed sequentially as described above, the elastic blade 101 is set under a state having a warp like the supporting plate 102 and the pressing plate 103. As shown in FIG. 13A, when the elastic blade 101 makes contact with the surface of the developing roller 55, the elastic blade 101 is curved with respect to the developing roller 55 so that the center part is located away from the developing roller 55 more than the end parts. Under this state, when the elastic blade 101 makes contact with the developing roller 55 as shown in FIG. 13B, the rubber member 104 of the elastic blade 101 receives a force in a direction to be stretched. As a result, the wavy phenomenon is not generated on the rubber member 104 and the elastic blade 101 can make contact with the surface of the developing roller 55 uniformly.

(Electrical Connection Structure of the Developing Unit)

Since the developing unit 22 is inserted removably in the image forming device 1, when inserting the developing unit 22, the voltage is supplied from the image forming device 1 to the developing roller 55, the supply roller 56 and the blade 100 in the developing unit 22. Therefore, as shown in FIG. 4, since the developing unit 22 is inserted into the image forming device 1 from the rear side of the developing unit 22, an electrode for supplying the voltage to the cover member 80 is provided on the rear side of the developing unit 22.

Figure 14:
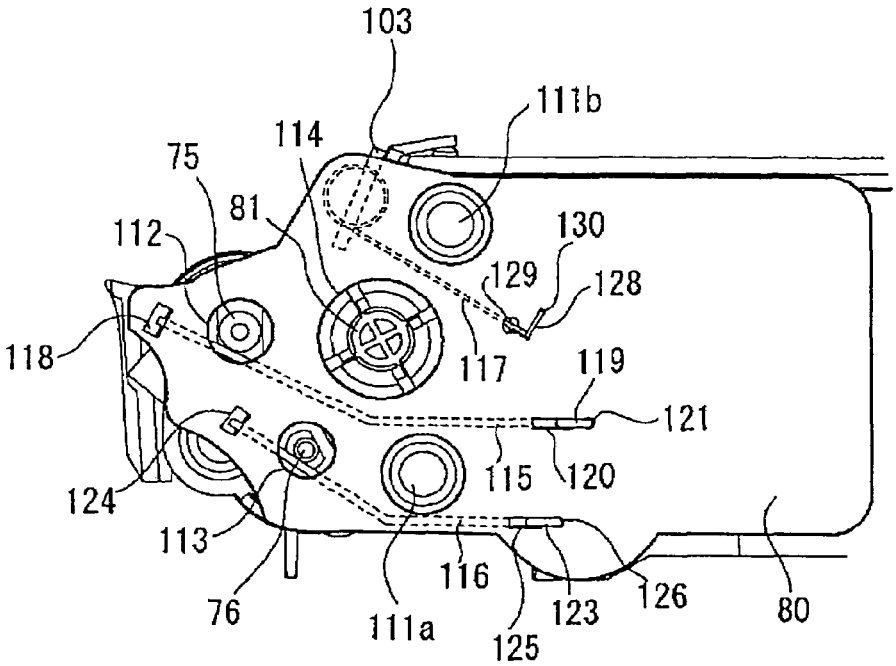
FIG. 14 is an enlarged view showing an electrical connection structure of the developing unit.
Figure 15:
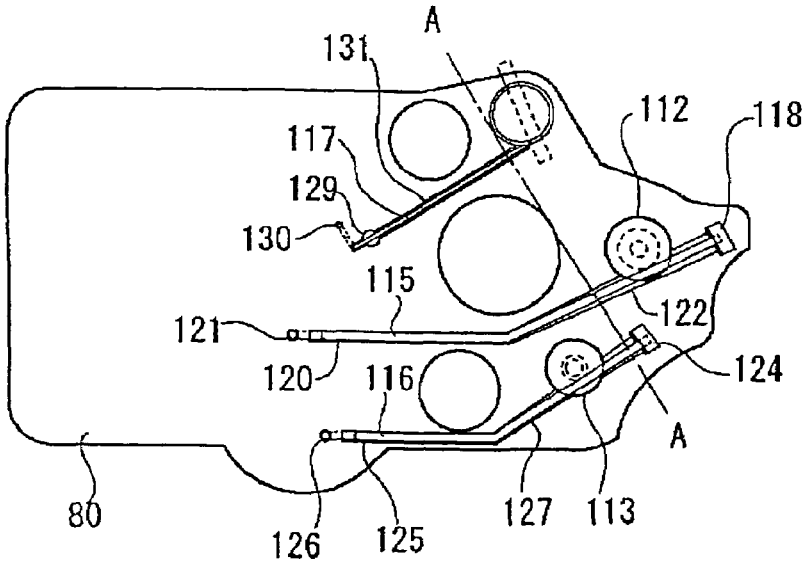
FIG. 15 is an enlarged view showing a reverse side of the cover member having the electrical connection structure.

FIG. 14 is an enlarged view of the cover member 80 attached on the rear side of the developing unit 22. FIG. 15 shows the cover member 80 viewed from the reverse side. The mounting holes 111*a* and 111*b* are formed on the cover member 80 for screwing the cover member 80 onto the rear frame 74. Circular openings 112, 113 and 114 are formed through the cover member 80 at positions corresponding to the rotational shaft 75 of the developing roller 55, the rotational shaft 76 of the supply roller 56 and the drive shaft 81, respectively. On the reverse side of the cover member 80, a first contact member 115 which makes contact with the rotational shaft 75 of the developing roller 55, a second contact member 116 which makes contact with the rotational shaft 76 of the supply roller 56 and a third contact member 117 which makes contact with the pressing plate 103 of the blade 100 are mounted.

The first contact member 115 is a metal wire rod formed in a hook shape bent at the center part. One end of the first contact member 115 is inserted and held at a holder 118 of the cover member 80. The holder 118 is formed to protrude toward the reverse side of the cover member 80 with a height difference. The holder 118 has an opening for inserting the first contact member 115 into the holder 118. Another end of the first contact member 115 is bent into a shape of a bracket to form a contact portion 119. The contact portion 119 is engaged and fixed in a narrow inserting hole 120 and a circular engaging hole 121 formed through the cover member 80. When mounting the contact portion 119 onto the cover member 80, first, the contact portion 119 is inserted into the inserting hole 120 from the reverse side and protrudes to the front side. Then, the bent tip end of the first contact member 115 is inserted into the engaging hole 121. By mounting the contact portion 119 as described above, the contact portion 119 is set under a state protruding from the front side of the cover member 80. The contact portion 119 reliably makes contact with the electrode of the image forming device 1, and can be connected electrically with the image forming device 1. Since a diameter of the engaging hole 121 is formed approximately the same as the diameter of the first contact member 115, the other end of the first contact member 115 is fixed tightly. Moreover, the one end of the first contact member 115 is held by the holder 118. Therefore, the first contact member 115 is not displaced from the cover member 80. A groove 122 is formed on the reverse side of the cover member 80. The groove 122 extends from the holder 118 to the inserting hole 120 along the shape of the first contact member 115. The first contact member 115 is fit in the groove 122. The groove 122 is formed to widen from the bent part at the center toward the holder 118. The opening of the holder 118 is set larger than the diameter of the first contact member 115. Therefore, with the bent part as a center of swing, a part of the first contact member 115 between the bent part and the tip end held by the holder 118 can swing in a width direction of the groove 122. The opening 112 for the rotational shaft 75 of the developing roller 55 is formed so as to cut out a part of the groove 122 located on the holder 118 toward the bent part. Therefore, when the rotational shaft 75 is provided in the opening 112, the first contact member 115 makes contact with a lower side of the rotational shaft 75. The first contact member 115 is swung downward in the groove 122 by making contact with the rotational shaft 75. Therefore, an elastic force to urge the first contact member 115 upward is generated and the first contact member 115 is in contact with the rotational shaft 75. Thus, the first contact member 115 and the rotational shaft 75 can be maintained under a stable contacting state and an electrical contacting state can be established reliably.

The second contact member 116 is also made of a metal rod-wire formed in a hook shape like the first contact member 115. Another end of the second contact member 116 is bent to form a contact portion 123 having a shape of a bracket. One end of the second contact member 116 is inserted and held at a holder 124 provided in the same manner as the holder 118. The contact portion 124 is engaged and fixed in a narrow inserting hole 125 and a circular engaging hole 126 provided on the cover member 80 like the contact portion 119. Therefore, the second contact member 116 is held reliably without being displaced from the cover member 80. In addition, the contact portion 124 is set under a state protruding from the front side of the cover member 80. The second contact member 116 reliably makes contact with the electrode of the image forming device 1 and can be connected electrically. Moreover, a groove 127 like the groove 122 is provided along the second contact member 116 on the reverse side of the cover member 80. The second contact member 116 is fit in the groove 127. An opening 113, where the rotational shaft 76 of the supply roller 56 is inserted through, is formed so as to cut out a part of the groove 127 located between the holder 124 and the bent part. When the rotational shaft 76 is provided in the opening 113, the second contact member 116 makes contact with a lower side of the rotational shaft 76 and is swung downward. Accordingly, an elastic force for urging the second contact member 116 upward is generated and the second contact member 116 is in contact with the rotational shaft 76. Therefore, in the same manner as the first contact member 115, the second contact member 116 and the rotational shaft 76 can be maintained under a stable contacting state and the electrical contacting state can be established reliably.

The third contact member 117 is made of a metal rod-wire having a small diameter. One end of the third contact member 117 is formed in a shape of a coil spring. Another end is bent perpendicularly in the shape of the letter L to form a contact portion 128. A tip end of the contact portion 128 is bent further into a hook-shape. When mounting the third contact member 117 onto the cover member 80, as shown in FIG. 15, the other end of the third contact member 117 is inserted from the reverse side into a circular inserting hole 129 formed on the cover member 80 so that the contact portion 128 is exposed to the front side of the cover member 80. The bent part at the tip end is inserted and fixed in a circular engaging hole 130. The diameter of the engaging hole 130 is formed approximately the same as the diameter of the third contact member 117. Therefore, the other end of the third contact member 117 is fixed tightly. A groove 131 is formed along the third contact member 117 on the reverse side of the cover member 80. A width of the groove 131 is formed to be approximately the same width as the diameter of the third contact member 117. Therefore, when the third contact member 117 is fit in the groove 131, the third contact member 117 is held tightly in the groove 131 without swinging. As a result, the third contact member 117 is held reliably without being displaced from the cover member 80. The contact portion 128 is set under a state protruding from the front side of the cover member 80. The third contact member 117 reliably makes contact with the electrode of the image forming device 1 and can be connected electrically. Moreover, when mounting the cover member 80 onto the rear frame 74, the part of the one end formed in the shape of the coil spring makes contact with the edge of the pressing plate 103 of the blade 100 and is maintained under a compressed state. Therefore, the third contact member 117 and the pressing plate 103 can be maintained under a stable contacting state and the electrical contacting state can be established reliably.

Figure 16:
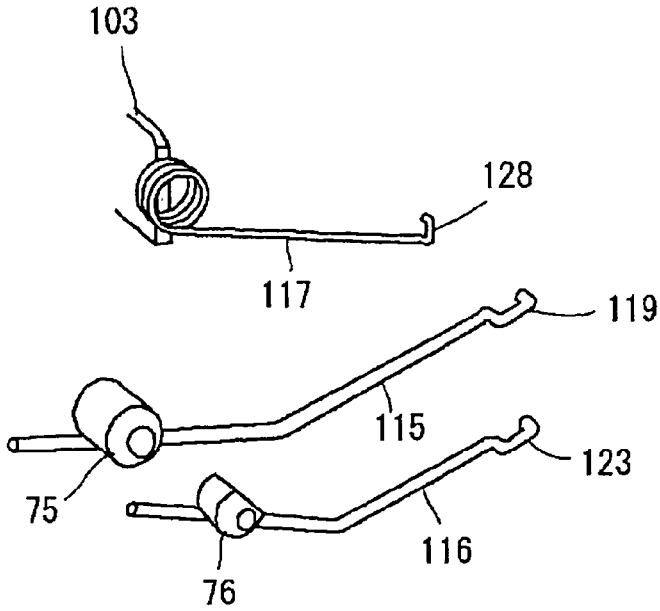
FIG. 16 is a perspective view showing contact members.

FIG. 16 is a perspective view showing the contacting states of the first contact member 115, the second contact member 116 and the third contact member 117. As shown in the drawing, the first contact member 115 is in contact with the lower side of the rotational shaft 75. The second contact member 116 is in contact with the lower side of the rotational shaft 76. The coil spring shaped part of the third contact member 117 is in contact with the pressing plate 103. In such a manner, a stable electrical contacting state is maintained. The contact portions of each of the contact members are set at prescribed positions according to a position of the electrode of the image forming device 1. The rotational shaft 75 is connected electrically to a developing sleeve at an external surface of the developing roller 55. The bias voltage from the image forming device 1 passes from the contact portion 119 through the first contact member 115, and impressed from the rotational shaft 75 onto the external surface of the developing roller 55. The rotational shaft 76 is connected electrically to an external surface of the supply roller 56. The bias voltage from the image forming device 1 passes from the contact portion 123 through the second contact member 116, and impressed from the rotational shaft 76 onto the external surface of the supply roller 56. The pressing plate 103 is tightened and fixed on the elastic blade 101 by the metal screws, and connected electrically with the elastic blade 101. The bias voltage from the image forming device 1 passes from the contact portion 128 through the third contact member 117, and impressed from the pressing plate 103 onto the elastic plate 101.

Figure 17:
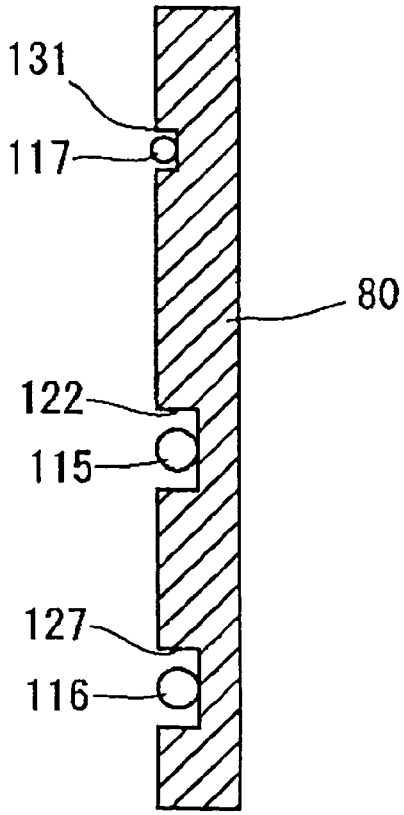
FIG. 17 is a cross-sectional view taken on line A—A of FIG. 15.

FIG. 17 is a cross-sectional view taken on line A—A in FIG. 15. Each of the contact members is disposed in each of the grooves formed on the reverse side of the cover member 80. The width of the grooves for the first contact member 115 and the second contact member 116 is widened so that the first contact member 115 and the second contact member 116 can be swung.

As described above, by using the rod-wires for the electrical connection structure, space can be saved. In addition, the positions of the contact portions or the like can be set without any restrictions and the structure of the image forming device 1 can be designed freely.

(Guide Mechanism for Inserting and Removing the Developing Unit)

Suppose that the front side in the perpendicular direction of the page of FIG. 2 is the front side of the developing unit 22 and the opposite side is the rear side of the developing unit 22. Then, the developing unit 22 is inserted and removed in the front-back direction, in other words, along the perpendicular direction of the page. Therefore, the developing unit 22 is inserted or removed along the axial direction of the photoconductive drum 25. When inserting or removing the developing unit 22, if the operator makes contact with the photoconductive drum 25 by the developing unit 22 by mistake, the photoconductive drum 25 is damaged. To prevent such a case, a guide mechanism is provided for guiding the developing unit 22 away from the photoconductive drum 25 at a certain distance.

Figure 18:
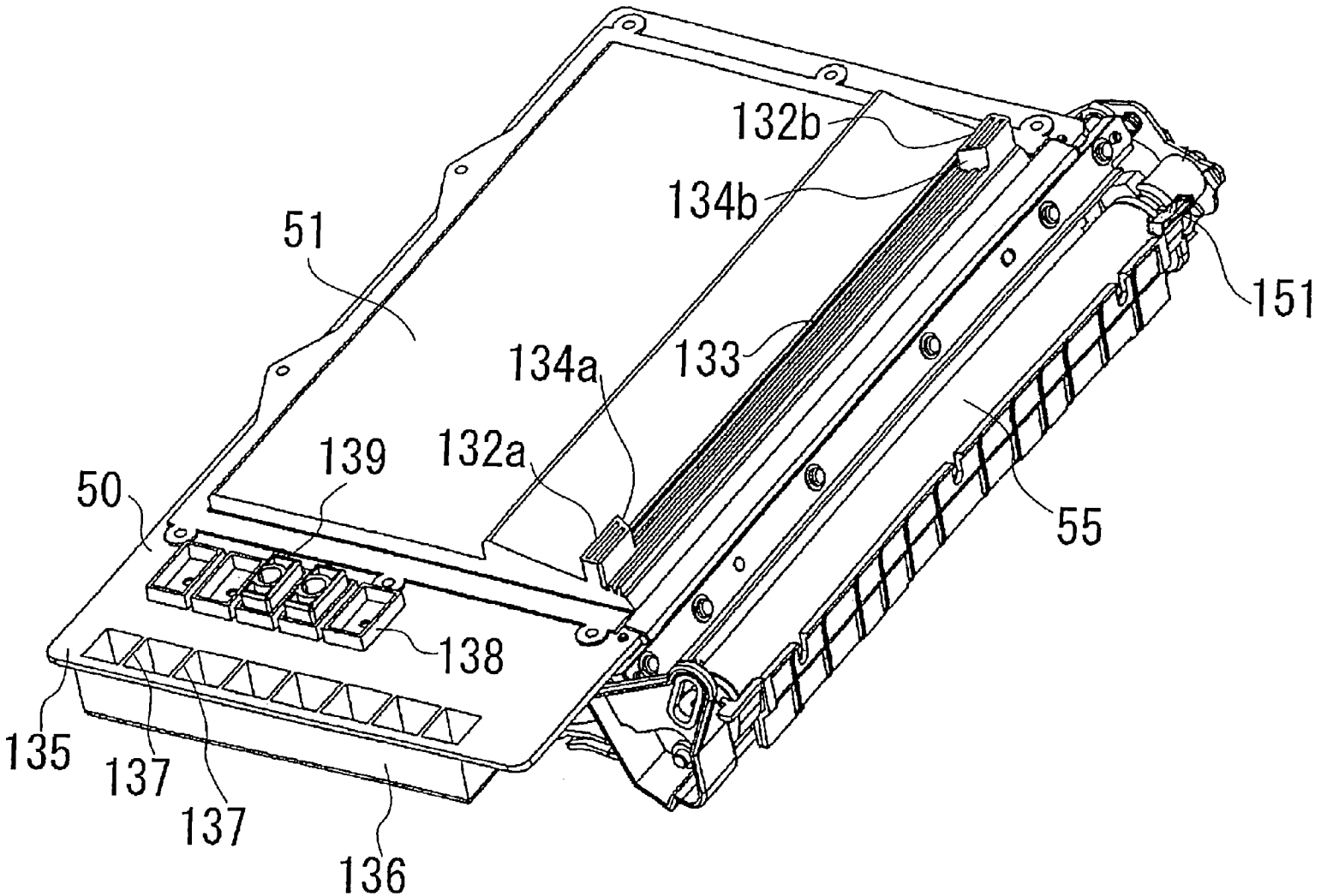
FIG. 18 is a perspective view of the developing unit viewed from an upper side.
Figure 19:
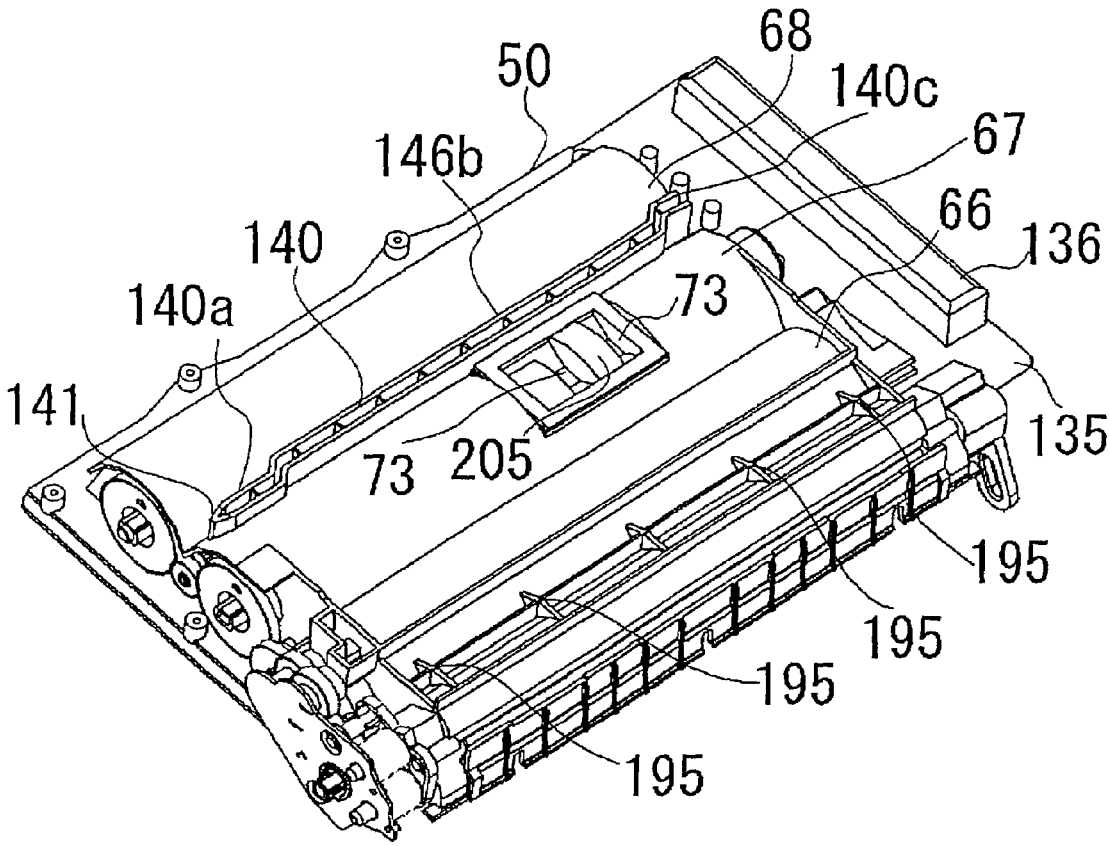
FIG. 19 is a perspective view of the developing unit viewed from a lower side.

As the guide mechanism, a plurality of protrusions are formed on the developing unit 22, and a guide unit is provided on the image forming device 1 for guiding the protrusions. The plurality of protrusions formed on the developing unit 22 are shown in FIG. 18 and FIG. 19. FIG. 18 is a perspective view of the developing unit 22 viewed from an upper side. FIG. 19 is a perspective view of the developing unit 22 viewed from a lower side.

As shown in FIG. 18, guide protrusions 132*a* and 132*b* are formed protruding upward on the cover 51, which is fixed on the upper part of the container 50 of the developing unit 22 by welding or with screws. The guide protrusions 132*a* and 132*b* are arranged on the cover 51 located on the side of the developing roller 55, along the inserting direction of the developing unit 22. The guide protrusion 132*a* is disposed at a rear side of the inserting direction. The guide protrusion 132*b* is disposed at a front side of the inserting direction. An interval between the guide protrusion 132*a* and the developing roller 55 is set slightly larger than an interval between the guide protrusion 132*b* and the developing roller 55. A cavity is formed inside the guide protrusions 132*a* and 132*b*. Ribs 133 are formed at a center part of the cavity along the inserting direction. Between the guide protrusions 132*a* and 132*b*, a plurality of ribs 133 are formed along the inserting direction. Side surfaces 134*a* and 134*b* of the guide protrusions 132*a* and 132*b* facing one another are slanted to widen toward the developing roller 55 according to an irradiating range of the laser light irradiated by the exposure head 27 shown in FIG. 2.

A flat plate 135 extends in a horizontal direction at the front side of the container 50. A grasping part 136 is formed downward on a lower surface of the flat plate 135. The grasping part 136 is a rectangular parallelepiped having an upper opening. A plurality of reinforcement ribs 137 are provided in the front-back direction in a gap inside the grasping part 136. Five rectangular frame-shaped attaching portions 138 protrude upward from an upper surface of the flat plate 135. Anti-counterfeit identification protrusions 139 are fit and fixed in the attaching portions 138. The identification protrusion 139 is provided in the attaching portion 138 selected randomly for each developing unit. Therefore, if the mounted position of the identification protrusion 139 is different, the developing unit cannot be inserted.

As shown in FIG. 19, a rail 140 protrudes from the bottom surface of the container 50 over the entire length in the inserting direction of the developing unit 22. The curved sliding surfaces 66, 67 and 68 are formed on the container 50. The rail 140 is provided in a valley between the sliding surfaces 67 and 68. In the rail 140, two sidewalls are formed at a prescribed interval and cross-rail ribs are formed to connect the sidewalls. The rail 140 consists of three linear portions 140*a*, 140*b* and 140*c*. An interval between the shaft of the developing roller 55 and the rail 140 is set to increase from the front side of the inserting direction (diagonally lower-leftward direction in FIG. 19) toward the rear side, in an order from 140*a*, 140*b* and 140*c*. The parts between each of the linear portions are formed in a diagonal direction with respect to the inserting direction. The sidewalls at the front side of the inserting direction of the linear portion 140*a* are closed and acuminated to form an inserting portion 141.

Figure 20:
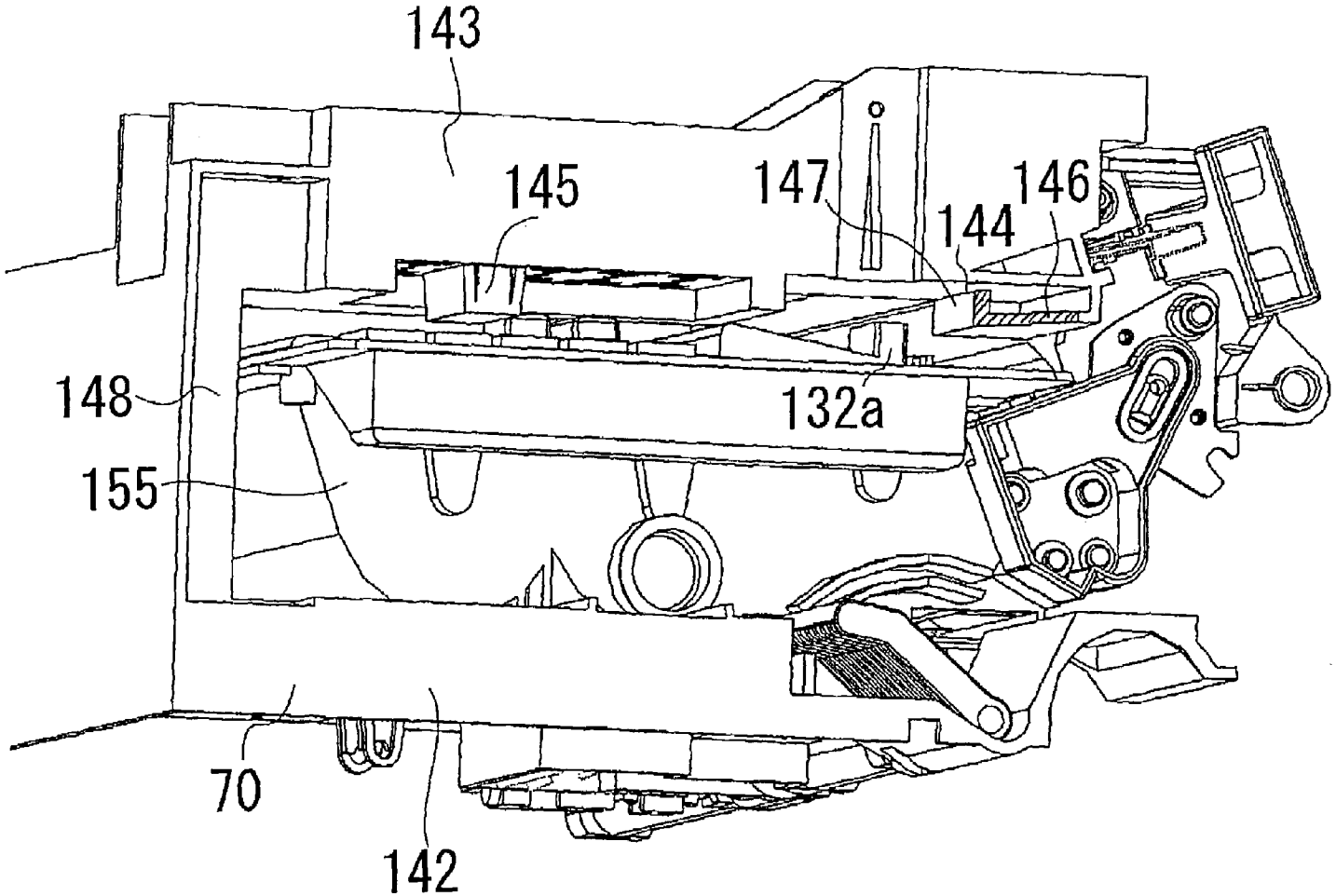
FIG. 20 is a perspective view showing a state in which the developing unit is inserted in a main frame viewed from a front side.

As shown in FIG. 20, in the main frame 70 of the image forming device 1, a space for inserting the developing unit 22 is provided between a bottom surface part 142 and an upper surface part 143. The height of the guide protrusions 132*a* and 132*b* is set so that when the developing unit 22 is inserted, a slight gap is formed between the developing unit 22 and a lower surface of the upper surface part 143. Accordingly, the developing unit 22 is prevented from moving vertically when inserting or removing the developing unit 22. On the lower surface of the upper surface part 143, a regulatory member 144 and an identification engaging portion 145 are formed protruding downward along an edge of a front opening at the front side of the page of FIG. 20. A guide surface 146 slanted in the inserting direction is formed on the regulatory member 144 at the front opening. A regulatory surface 147 located on the opposite side of the photoconductive drum 25 is positioned so that the developing unit 22 is inserted apart from the photoconductive drum 25. When the guide protrusion 132*a* or 132*b* reaches a position regulated by the regulatory surface 147, since there is only a slight gap between the side surface of the developing unit 22 and a side surface 148 of the main frame 70, the developing unit 22 is inserted and removed without being moved to the left or the right. The identification engaging portion 145 is disposed at a position where the identification protrusion 139 protruding from the developing unit 22 is not provided. When a developing unit having an identification protrusion 139 not corresponding to the identification engaging portion 145 is inserted, the identification protrusion 139 makes contact with the identification engaging portion 145 and the developing unit cannot be inserted.

Figure 21:
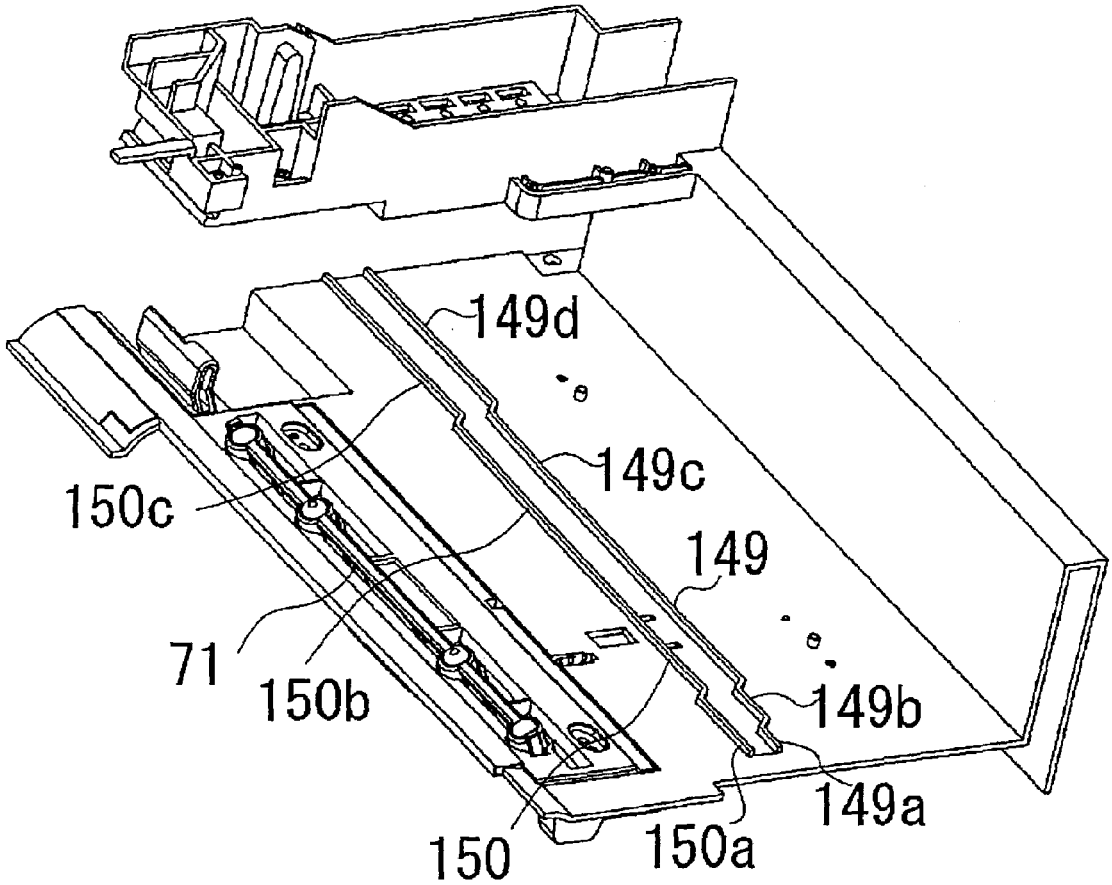
FIG. 21 is a perspective view showing an upper surface of a bottom surface part of the main frame.

As shown in FIG. 21, linear guide units 149 and 150 protrude from the upper surface of the bottom surface part 142 of the main frame 70 along the inserting direction of the developing unit 22. The developing unit 22 is inserted or removed along the axial direction of the photoconductive drum 25. Therefore, the guide units 149 and 150 are formed along the photoconductive drum 25. The guide units 149 and 150 are arranged at a prescribed interval. An interval between the guide unit 149 and the photoconductive drum 25 is set larger than an interval between the guide unit 150 and the photoconductive drum 25. In the guide unit 149, linear portions 149*a*, 149*b*, 149*c* and 149*d* are formed in an order from the rear side (the front side of the inserting direction of the developing unit 22, and the front side of the page of FIG. 21). An interval between the guide unit 149 and the photoconductive drum 25 is set to increase sequentially from the rear side toward the front side (the rear side of the inserting direction of the developing unit 22, and the back side of the page of FIG. 21). Parts between each of the linear portions are formed in a diagonal direction with respect to the inserting direction. Meanwhile, in the guide unit 150, linear portions 150*a*, 150*b* and 150*c* are also formed in an order from the rear side. The linear portion 150*a* is disposed in accordance with the linear portions 149*a* and 149*b*. The linear portion 150*b* is disposed in accordance with the linear portion 149*c*. The linear portion 150*c* is disposed in accordance with the linear portion 149*d*. Therefore, each of the linear portions of the guide unit 150 is also set so that an interval between the guide unit 150 and the photoconductive drum 25 increases sequentially from the rear side toward the front side.

Figure 22:
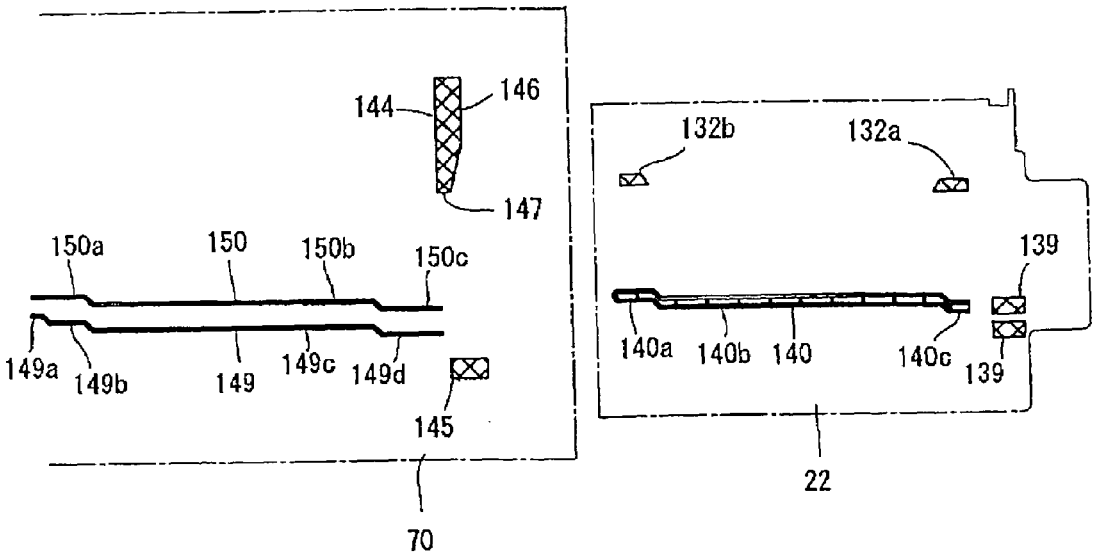
FIG. 22 shows a state in which the developing unit is inserted into the main frame.
Figure 23:
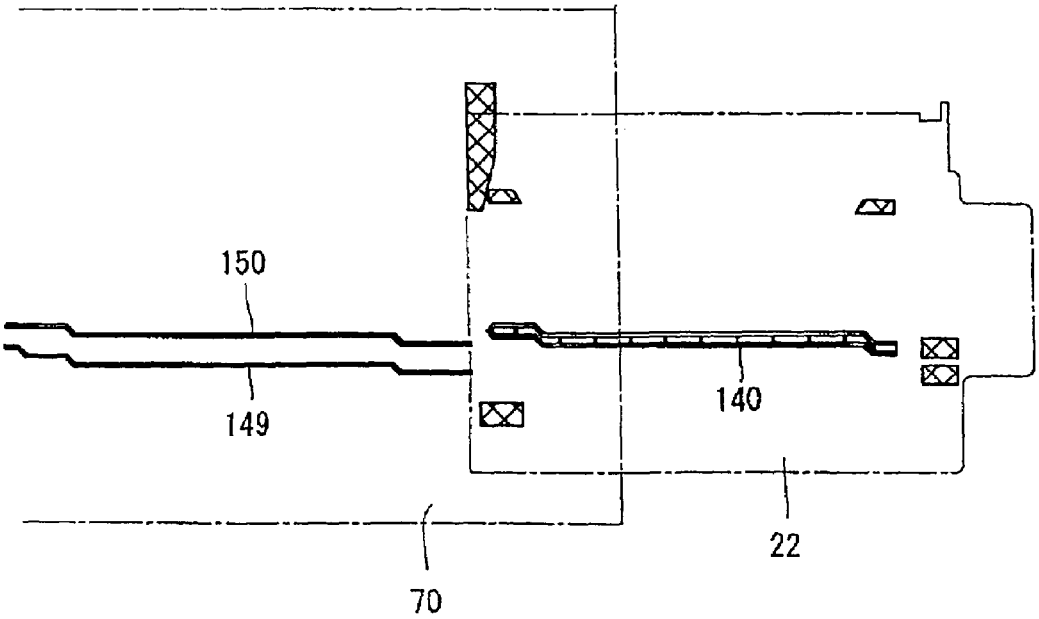
FIG. 23 shows a state in which the developing unit is inserted into the main frame.
Figure 24:
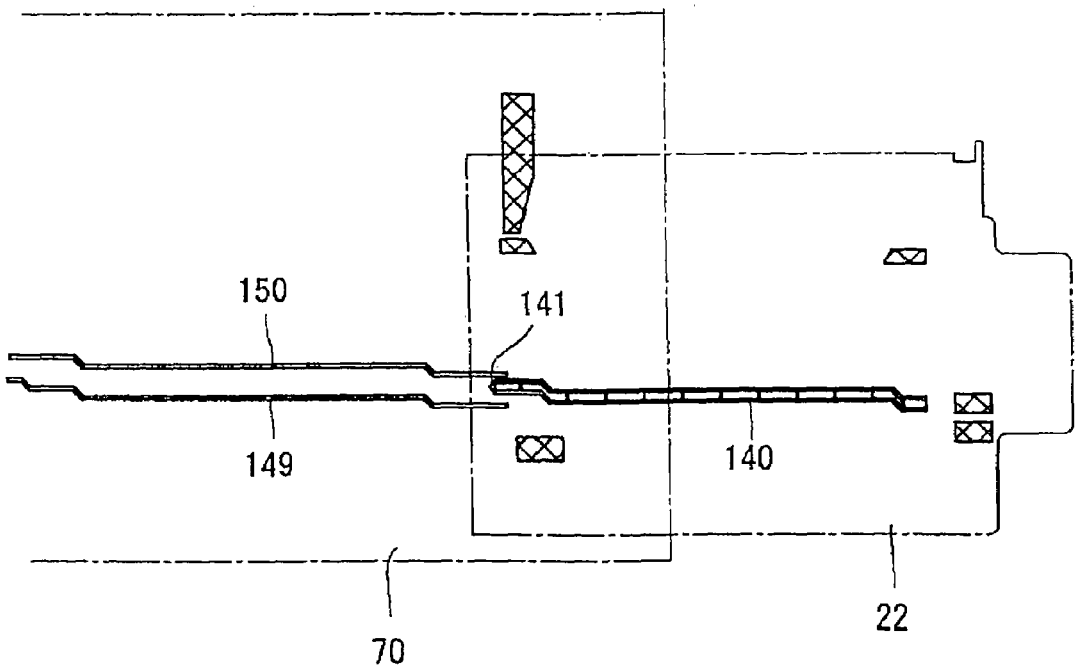
FIG. 24 shows a state in which the developing unit is inserted into the main frame.

The rail 140 protruding from the bottom surface of the developing unit 22 is inserted and guided between the guide units 149 and 150. When the inserting portion 141 of the rail 140 is inserted, as described above, the inserting position of the developing unit 22 is regulated by the regulatory member 144 and the side surface 148 of the main frame 70. Therefore, the inserting portion 141 is guided and inserted between the linear portion 149*d* of the guide unit 140 and the linear portion 150*c* of the guide unit 150. FIG. 22 through FIG. 24 schematically show such a process. FIG. 22 is a plane view showing a state before the developing unit 22 is inserted into the main frame 70. FIG. 23 shows a state in which the developing unit 22 is inserted into the main frame 70 and the guide protrusion 132*b* makes contact with the guide surface 146 of the regulatory member 144. Since the guide surface 146 is slanted in the inserting direction, the developing unit 22 is guided toward the regulatory surface 147 and inserted at a position away from the photoconductive drum 25 as shown in FIG. 24. At this time, as described above, the inserting portion 141 of the rail 140 is inserted between the guide units 149 and 150.

Figure 25:
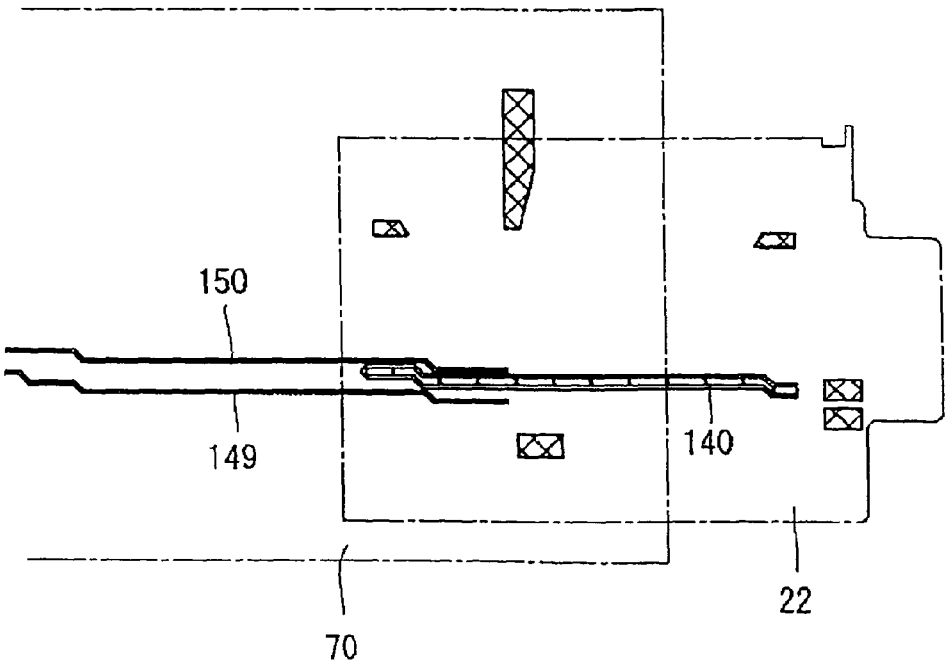
FIG. 25 shows a state in which the developing unit is inserted into the main frame.
Figure 26:
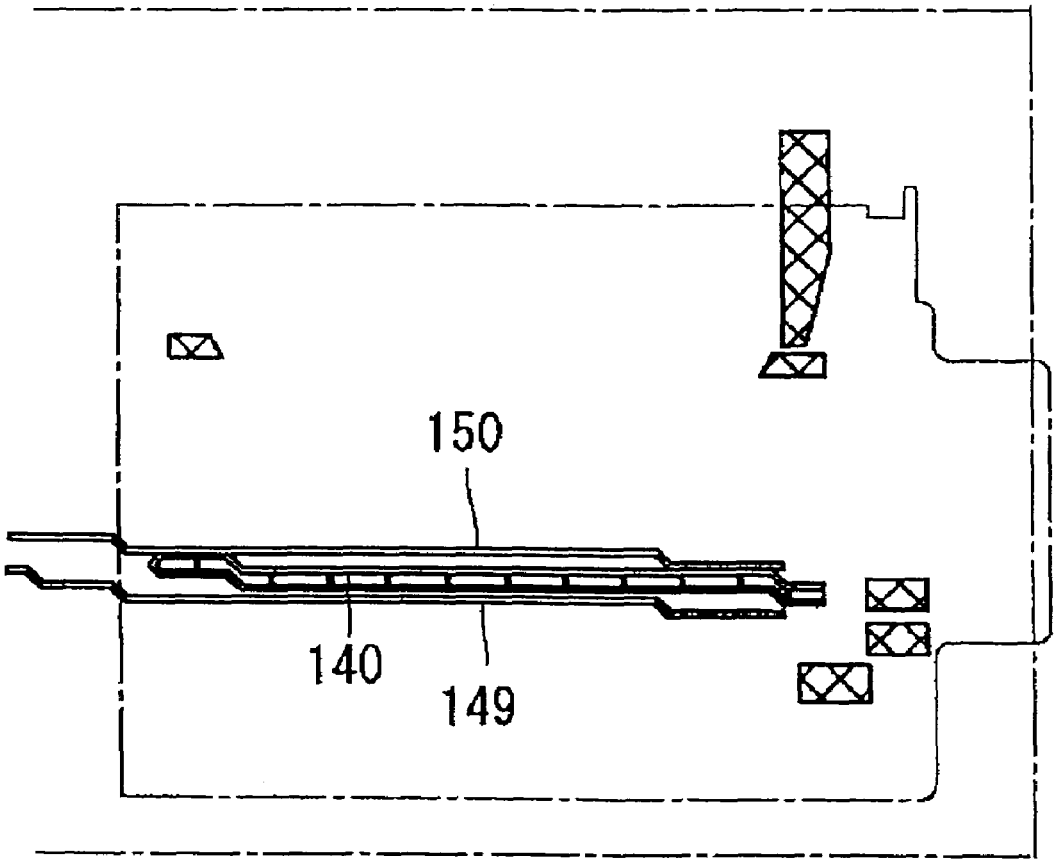
FIG. 26 shows a state in which the developing unit is inserted into the main frame.
Figure 27:
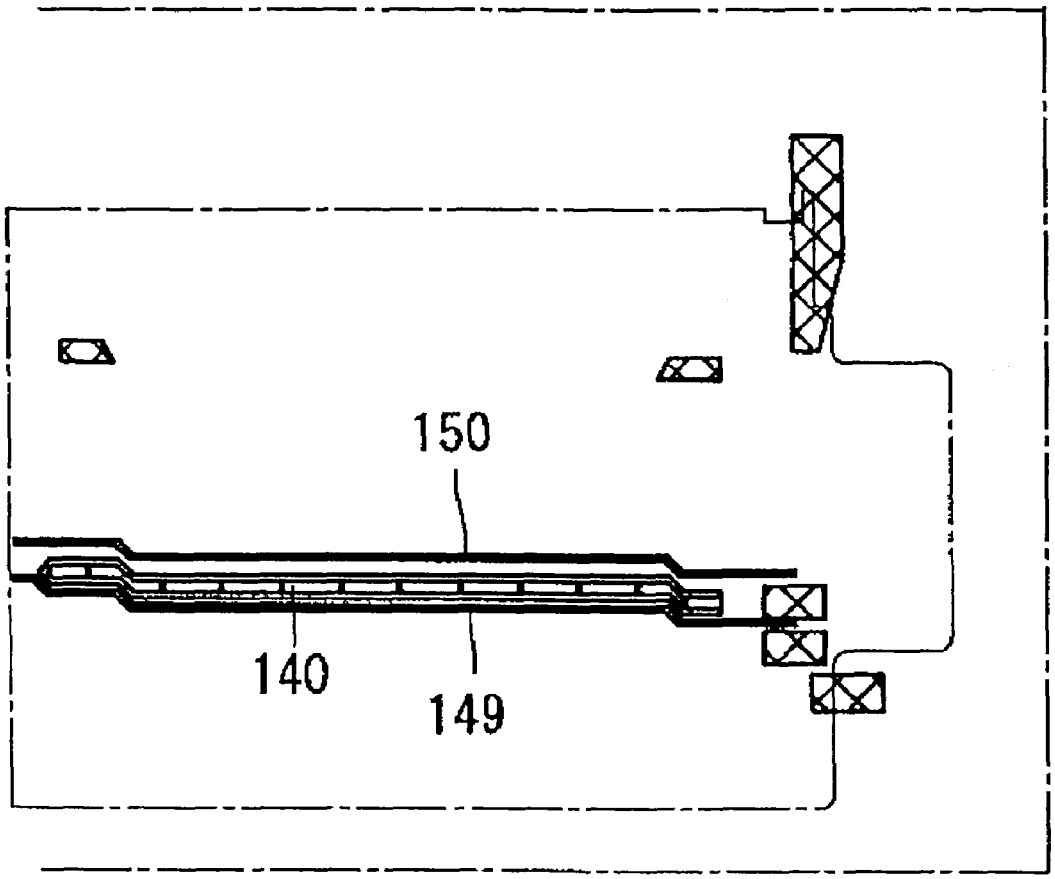
FIG. 27 shows a state in which the developing unit is inserted into the main frame.

As shown in FIG. 25, when the developing unit 22 is inserted further, the inserting portion 141 is guided between the linear portions 149*c* and 150*b*, and the developing unit 22 moves toward the photoconductive drum 25. When the developing unit 22 continues to be inserted, as shown in FIG. 26, the identification protrusions 139 provided on the upper surface of the developing unit 22 approach the identification engaging portion 145 of the main frame 70. If the positions of the identification protrusions 139 and the identification engaging portion 145 do not overlap, the developing unit 22 can pass as a regular developing unit. After the identification protrusions 139 pass the identification engaging portion 145, as shown in FIG. 27, the linear portions

Figure 28:
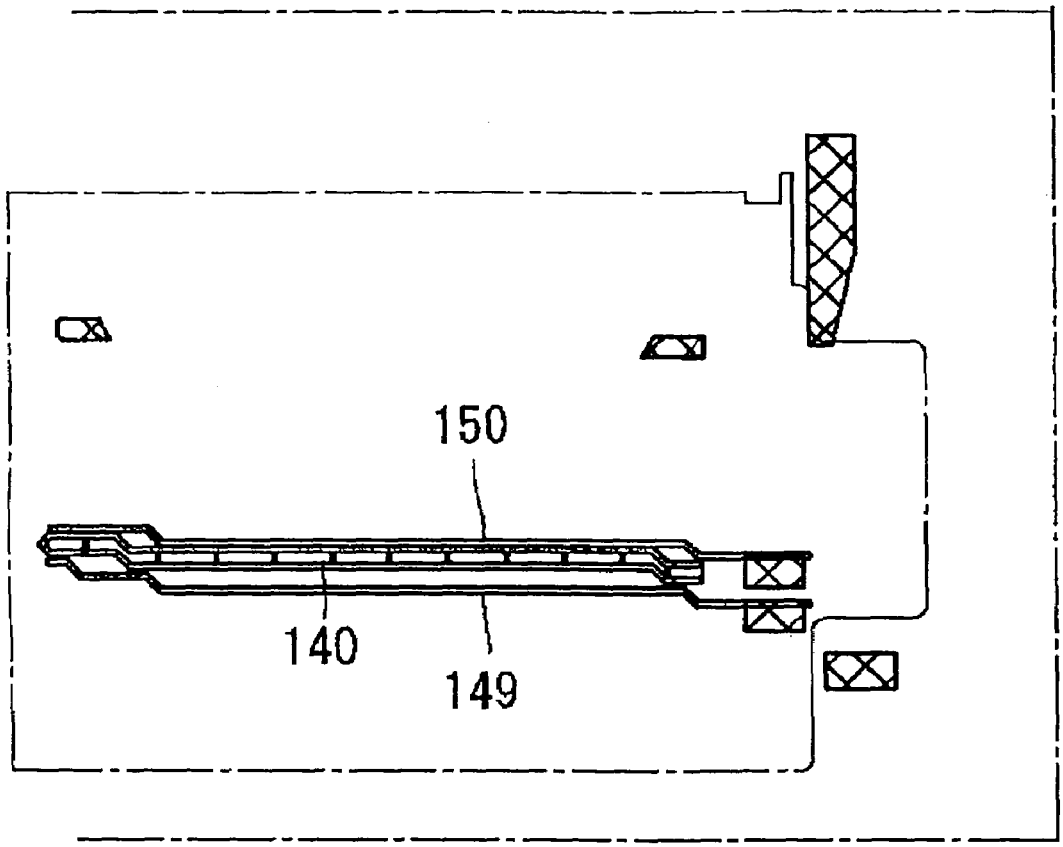
FIG. 28 shows a state in which the developing unit is inserted into the main frame.
Figure 29:
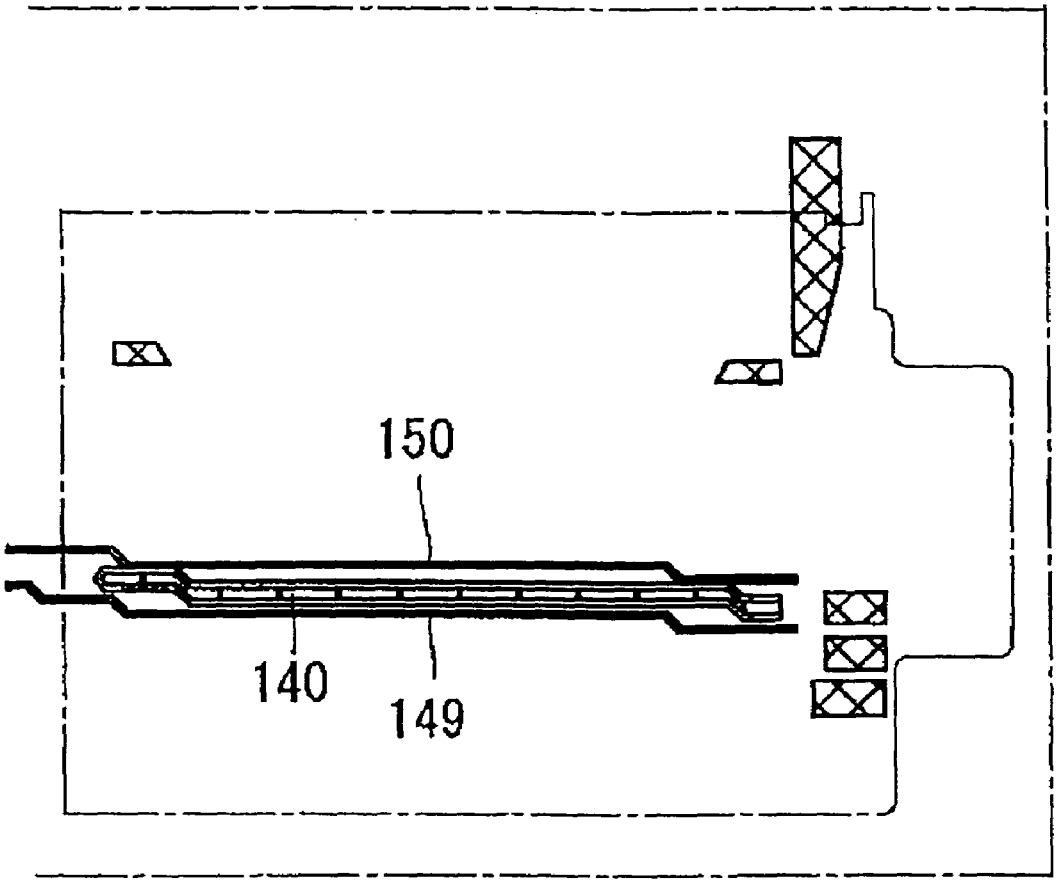
FIG. 29 shows a state in which the developing unit is inserted into the main frame.

140*a*, 140*b* and 140*c* of the rail 140 are inserted into positions making contact with the linear portions 149*b*, 149*c* and 149*d* of the guide unit 149, respectively. When the developing unit 22 is inserted further, as shown in FIG. 28, the linear portion 149*a* of the guide unit 149 and the linear portion 140*a* of the rail 140 are engaged with one another. Accordingly, the developing unit 22 moves to a position closer to the photoconductive drum 25. As described above, the developing unit 22 is inserted without making contact with the surface of the photoconductive drum 25 while being guided sequentially to a position located close to the photoconductive drum 25. When removing the developing unit 22, as shown in FIG. 29, the linear portion 140*a* of the rail 140 and the linear portion 150*b* of the guide unit 150 are engaged with one another and the developing unit 22 is moved in a direction to depart from the photoconductive drum 25. Therefore, the developing unit 22 is sequentially moved away from the photoconductive drum 25 by the drawing movement. When the guide protrusion 132*a* passes the regulatory surface 147 of the main frame 70, the drawing movement of the developing unit 22 can be carried out further. An interval between the guide protrusion 132*a* and the developing roller 55 is set larger than an interval between the guide protrusion 132*b* and the developing roller 55 in accordance with the movement of the developing unit 22 by the rail 140. In case the rail 140 is displaced from the guide unit 150, the guide protrusion 132*a* makes contact with the regulatory member 144 and the developing unit 22 cannot be removed. Therefore, the developing unit 22 cannot be removed unless the developing unit 22 is located away from the photoconductive drum 25. As a result, safety when removing the developing unit 22 is improved.

At the front side of the inserting direction of the developing unit 22, as shown in FIG. 18, an elastic member 151 is adhered and fixed at a position protruding toward the photoconductive drum 25. The elastic member 151 is made of a material having elasticity such as a felt or a sponge, formed into a rectangular parallelepiped. Even when the elastic member 151 makes contact with the photoconductive drum 25, the photoconductive drum 25 is not damaged. The elastic member 151 is disposed in the proximity to the front side of the inserting direction of the developing roller 55. The elastic member 151 is fixed at a position protruding the most toward the photoconductive drum 25. Therefore, by mounting the elastic member 151 at a position most probable to make contact with the photoconductive drum 25 immediately before positioning the developing unit 22 so that the developing roller 55 is located at a position making contact with the photoconductive drum 25 or when removing the developing unit 22 from the positioned state, even if the developing unit 22 makes contact with the photoconductive drum 25, the photoconductive drum 25 is prevented from being damaged.

(Positioning Mechanism of the Developing Unit)

As shown in FIG. 28, after the developing unit 22 is inserted on an innermost part of the main frame 70, the developing unit 22 is positioned so that the developing roller 55 makes contact with the photoconductive drum 25 uniformly.

Figure 30:
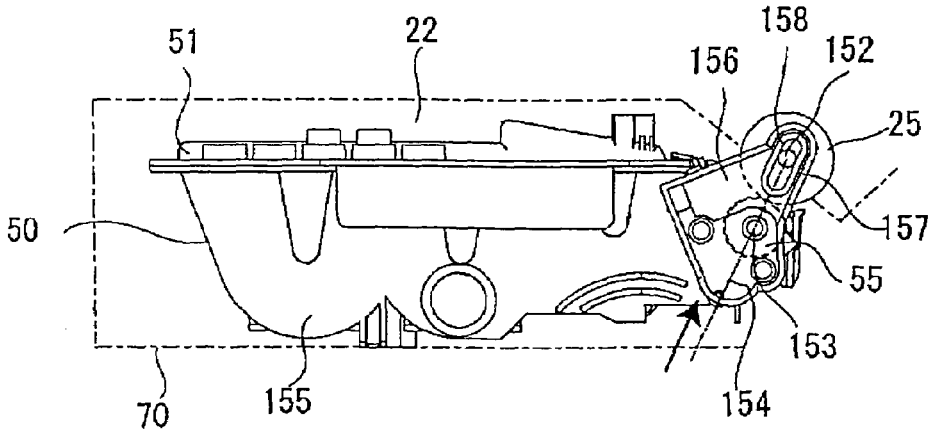
FIG. 30 shows the inserted developing unit viewed from the front side.

As shown in FIG. 2, the pressing mechanism 71 is disposed on the bottom surface of the main frame 70. The pressing mechanism 71 pushes up the bottom surface of the container 50 of the developing unit 22, and the developing roller 55 is pressed against the photoconductive drum 25. FIG. 30 shows a state in which the developing unit 22 is inserted in the main frame 70 viewed from the front side. The pressing mechanism 71 presses in a direction of an arrow parallel along a straight line 154 that is orthogonal to the rotational center shafts 152 and 153 of the photoconductive drum 25 and the developing roller 55.

A guide member 156 is fixed on a front frame 155 of the container 50 so that the developing roller 55 is set accurately on the photoconductive drum 25 when pressed by the pressing mechanism 71. The guide member 156 is a flat plate fixed at a position on the front frame 155 located on the photoconductive drum 25. A guide unit 157 is formed extending toward the rotational center shaft 152 of the photoconductive drum 25. An oval guide hole 158 is formed through the guide unit 157 along the straight line 154. The width of the guide hole 158 is set so that the rotational center shaft 152 can be fit in.

Figure 31:
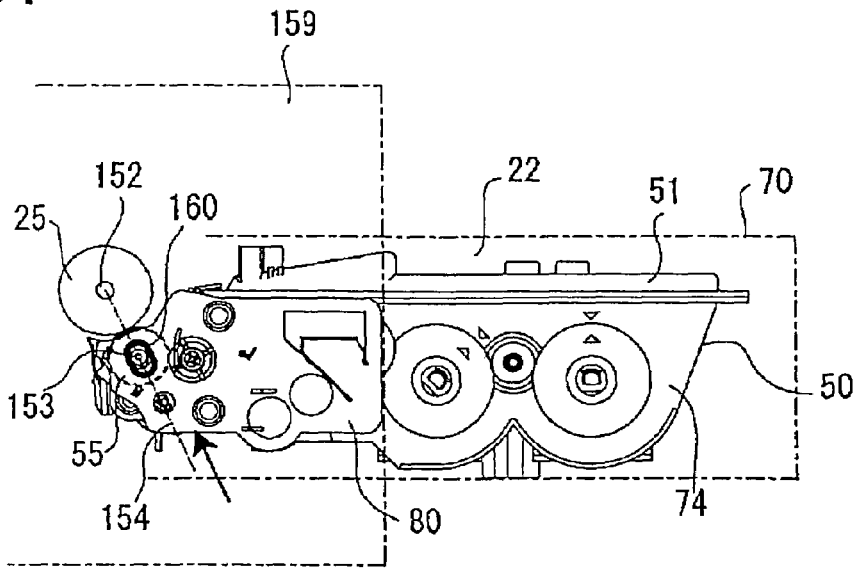
FIG. 31 shows the inserted developing unit viewed from the rear side.

Meanwhile, as shown in FIG. 31, at the rear side of the developing unit 22, a positioning long hole 160 is formed through a rear surface 159 of the main frame 70 along the straight line 154. The width of the positioning long hole 160 is set so that the rotational center shaft 153 of the developing roller 55 can be accommodated.

Figure 32:
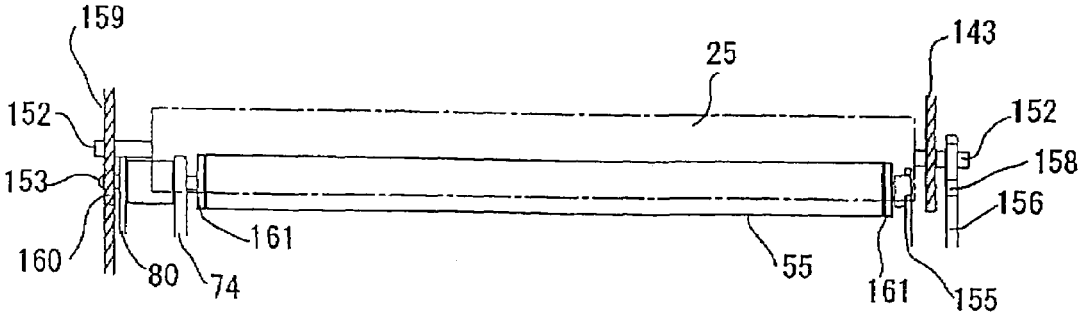
FIG. 32 is an explanatory drawing relating to a positioning state of a photoconductive drum and the developing roller.

FIG. 32 is a schematic view showing a state in which the developing roller 55 makes contact with the photoconductive drum 25. A front end part of the rotational center shaft 152 of the photoconductive drum 25 is supported by the upper surface part 143 of the main frame 70. A rear end part of the rotational center shaft 152 is supported by the rear surface 159. As shown in FIG. 28, when the developing unit 22 is inserted, an end part of the rotational center shaft 153 of the developing roller 55 is guided to be inserted into the positioning long hole 160. Further, the rotational center shaft 153 protrudes outward from the cover member 80 mounted on the rear side of the developing unit 22. At the same time, the guide hole 158 of the guide member 157 fixed on the front side of the developing unit 22 is guided to be fit into the end part of the rotational center shaft 152 of the photoconductive drum 25 protruding outward from the upper surface part 143.

As described above, the rotational center shaft 152 of the photoconductive drum 25 is set in the guide hole 158 and the rotational center shaft 153 of the developing roller 55 is set in the positioning long hole 160, and the pressing mechanism 71 operates to push the developing unit 22 upward. In this case, since the shapes of the guide hole 158 and the positioning long hole 160 are formed along the straight line 154, the developing unit 22 moves along the straight lint 154. The rotational center shaft 153 of the developing roller 55 is set at a position to be parallel with the rotational center shaft 152 of the photoconductive drum 25. At both sides of the developing roller 55, gap rollers 161 are fixed on the rotational center shaft 153. The gap rollers 161 maintain the gap between the surface of the photoconductive drum 25 and the rotational center shaft 153 of the developing roller 55 at a prescribed gap. Therefore, the gap rollers 161 are set slightly smaller than the diameter of the developing roller 55. The gap rollers 161 are pressed against the surface of the photoconductive drum 25 by a pressing force of the pressing mechanism 71. Accordingly, the developing roller 55 can be pressed uniformly against the surface of the photoconductive drum 25.

When the photoconductive drum 25 and the developing roller 55 are driven and rotated, the developing roller 55 is dragged in the rotational direction of the photoconductive drum 25. As described above, the widths of the guide hole 158 and the positioning long hole 160 are set so that the rotational center shafts 152 and 153 can be accommodated, respectively. Therefore, the developing unit 22 is regulated by each of the holes and not displaced from the set position.

(Pressing Mechanism of the Developing Unit)

Figure 33:
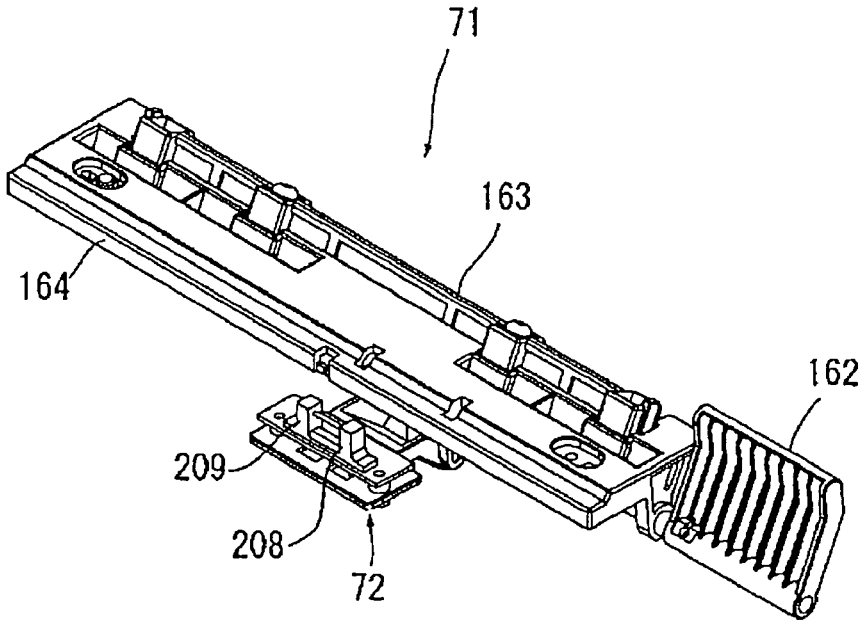
FIG. 33 is a perspective view showing an operating state of a pressing mechanism.
Figure 34:
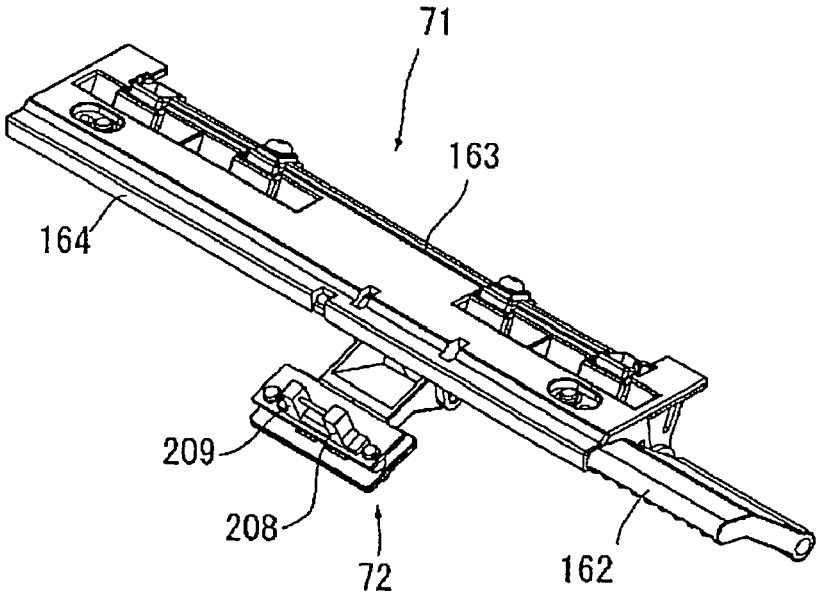
FIG. 34 is a perspective view showing a standby state of the pressing mechanism.

Next, the pressing mechanism 71 will be described. As shown in FIG. 2 and FIG. 21, the pressing mechanism 71 is disposed on the bottom surface part 142 of the main frame 70 located on the developing unit 25. FIG. 33 and FIG. 34 are perspective views showing the pressing mechanism 71. FIG. 33 shows a state in which an operation unit 162 rotates manually to an operational position, and a rectangular pressing plate 163 is elevated and protrudes from a board 164. FIG. 34 shows a state in which the operation unit 162 rotates manually in the counterclockwise direction to a standby position and the pressing plate 163 is lowered. In FIG. 33, accompanying the rotational movement of the operation unit 162 to the operational position, the remaining toner detecting sensor 72 is swung to a set position in the replenish chamber of the developing unit 22. In FIG. 34, accompanying the rotational movement of the operation unit 162 to the standby position, the remaining toner detecting sensor 72 is swung to a receded position.

Figure 35:
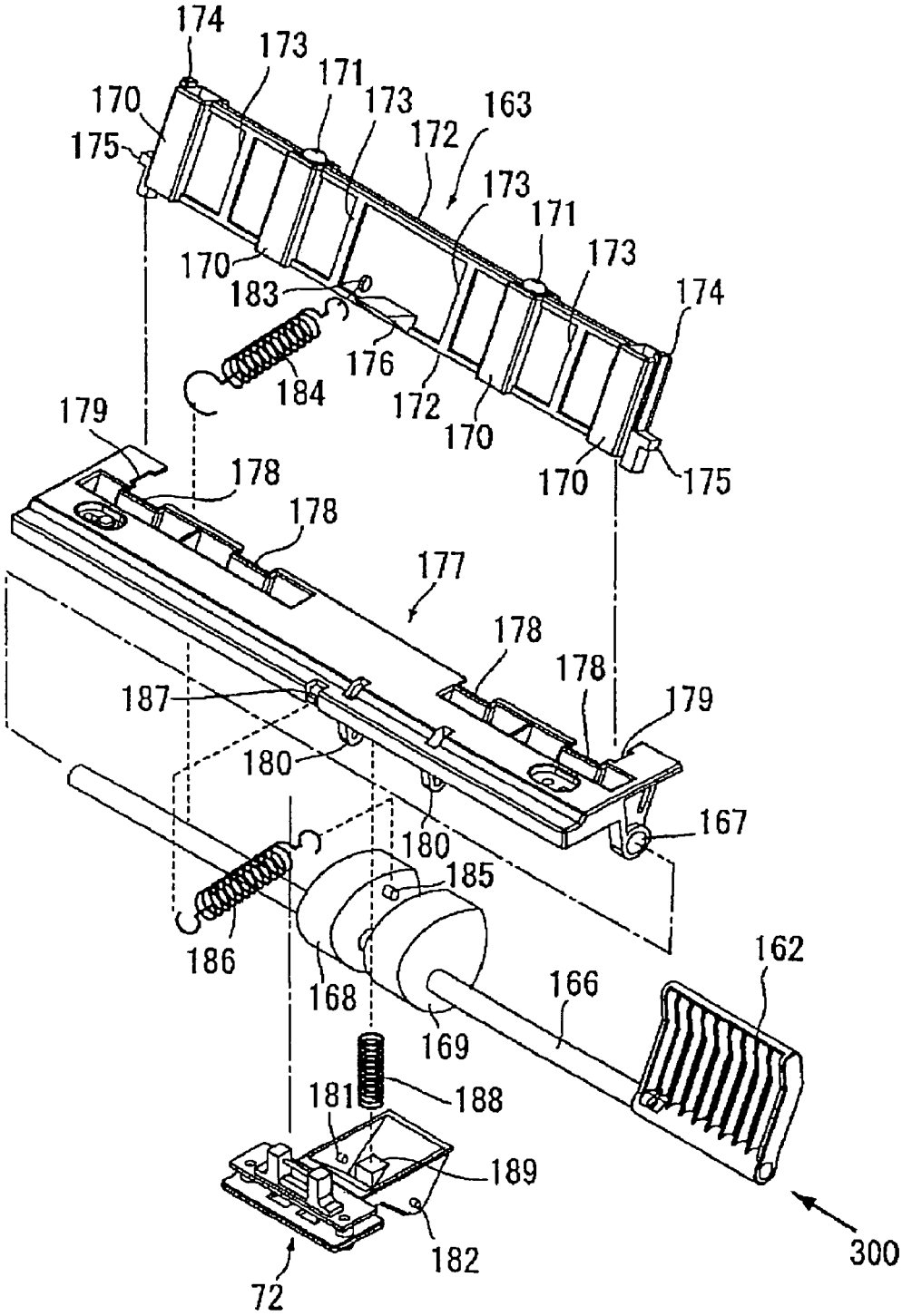
FIG. 35 is an exploded perspective view of the pressing mechanism.

FIG. 35 is an exploded perspective view of the pressing mechanism 71. The operation unit 162 is fixed on a front end part of an actuating rotational shaft 166. The actuating rotational shaft 166 is held rotatably on bearings 167 hanging downward at the front edge and the rear edge of the board 164. A cam member 168 for a plate and a cam member 169 for a sensor are fixed at an intermediate part of the actuating rotational shaft 166. The pressing plate 163 extends as a long thin plate in the front-back direction. Four holders 170 for accommodating acting members 171 are formed on the pressing plate 163. In the example shown in FIG. 35, the acting members 171 are accommodated in the two holders 170 at a center part. The two other holders 170 at end parts are empty. Each of the holders 170 is formed in a prism shape. A rectangular space is formed inside each of the holders 170 for accommodating the acting member 171. At each of positions symmetrical with respect to a centerline of the pressing plate 163 in the vertical direction, two holders 170 are disposed front and back. Ribs 172 are formed at upper and lower edges of the pressing plate 163. Vertical ribs 173 are formed at a prescribed interval for connecting the upper and the lower ribs 172 to increase the strength of the pressing plate 163. Guide protrusions 174 are formed at both edges of the pressing plate 163 in the front-back direction. A regulatory protrusion 175 protrudes at the lower part of the guide protrusion 174. A cam receiver 176 protrudes in a horizontal direction at the center part of the lower edge of the pressing plate 163.

A cutout 177 is formed on a side of the board 164 located closer to the photoconductive drum 25, in accordance with the mounted position of the pressing plate 163. In the cutout 177, holder receivers 178 are formed for receiving the holders 170 on the pressing plate 163. Concaves 179 are formed at front and back sides of the cutout 177 for the guide protrusions 174 to move vertically. Each of the holder receivers 178 has a guide surface that is parallel to the straight line 154 shown in FIG. 30. A groove (not shown) is formed inside the bearings 167 for moving the regulatory protrusions 175 vertically along the straight line 154.

When mounting the pressing plate 163 onto the board 164, the regulatory protrusions 175 are inserted into the groove, and the guide protrusions 174 are fit in the concaves 179 to fit each of the holders 170 into each of the holder receivers 178. Under the mounted state, the pressing plate 163 moves vertically along the straight line 154 by the guide surfaces of the holder receivers 178 and the groove in which the regulatory protrusions 175 are inserted.

Meanwhile, from a side surface of the board 164, which does not face the photoconductive drum 25, a pair of bearings 180 hang at the center part for supporting the remaining toner detecting sensor 72 rotatably. A pair of rotational shafts 182 protrude from side surfaces in the front-back direction of an attaching portion 181 provided in the remaining toner detecting sensor 72. The attaching portion 181 is inserted between the pair of bearings 180. The rotational shafts 182 are fit in the bearings 180, and the remaining toner detecting sensor 72 is attached.

An engaging hole 183 is formed through the pressing plate 163 in proximity to the cam receiver 176. One end of a coil spring 184 for the plate is engaged in the engaging hole 183. Another end of the coil spring 184 is engaged with the actuating rotational shaft 166. The coil spring 184 urges the pressing plate 163 to be pulled toward the actuating rotational shaft 166 at all times. When the pressing plate 163 is urged by the coil spring 184, the pressing plate 163 moves downward and the bottom surfaces of the regulatory protrusions 175 make contact with the actuating rotational shaft 166. Accordingly, the pressing plate 163 is held.

An engaging protrusion 185 protrudes from the side surface of the cam member 168. One end of a coil spring 186 for the cam is engaged in the engaging protrusion 185. Another end of the coil spring 186 is engaged in an engaging hole 187. The engaging hole 187 is formed through the board 164 in proximity to the bearing 180. The coil spring 186 urges the cam member 168 at all times to rotate the cam member 168 counterclockwise when viewed from a direction of the arrow 300 of FIG. 35. Therefore, when the cam member 168 rotates counterclockwise by the coil spring 186, the actuating rotational shaft 166 also rotates and the operation unit 162 is swung to the standby position.

A compression spring 188 is mounted between the lower surface of the board 164 and an inner part of the attaching portion 181 of the remaining toner detecting sensor 72. The compression spring 188 works to press a contact portion 189, which is formed at a position located closer to the photoconductive drum 25 than the rotational shaft 182. Therefore, the remaining toner detecting sensor 72 is urged to be rotated clockwise at all times.

Figure 36:
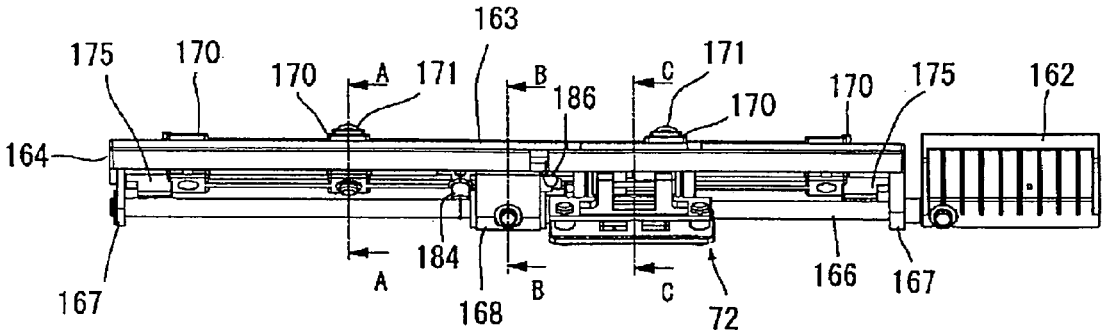
FIG. 36 is a side view showing the standby state of the pressing mechanism.
Figure 37A:
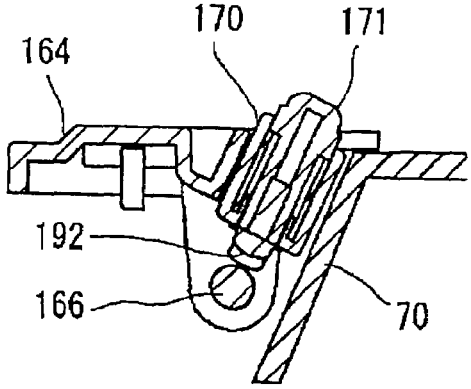
FIG. 37A is a cross-sectional view taken on line A—A of FIG. 36.
Figure 37B:
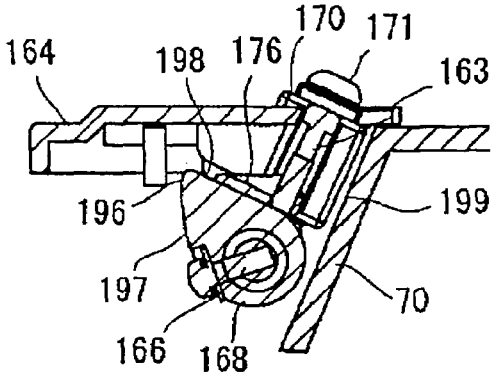
FIG. 37B is a cross-sectional view taken on line B—B of FIG. 36.
Figure 37C:
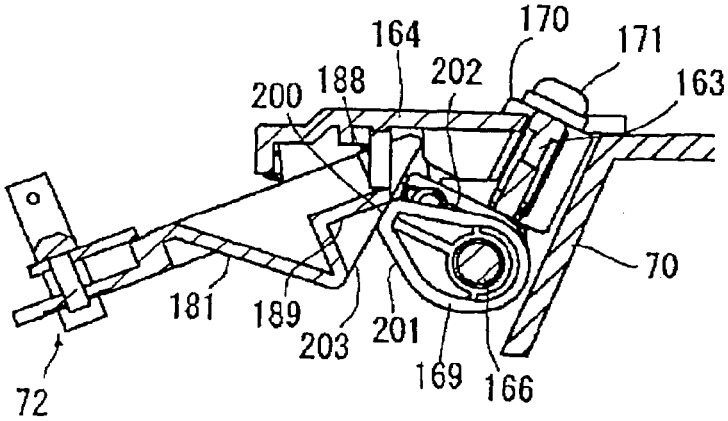
FIG. 37C is a cross-sectional view taken on line C—C of FIG. 36.
Figure 38:
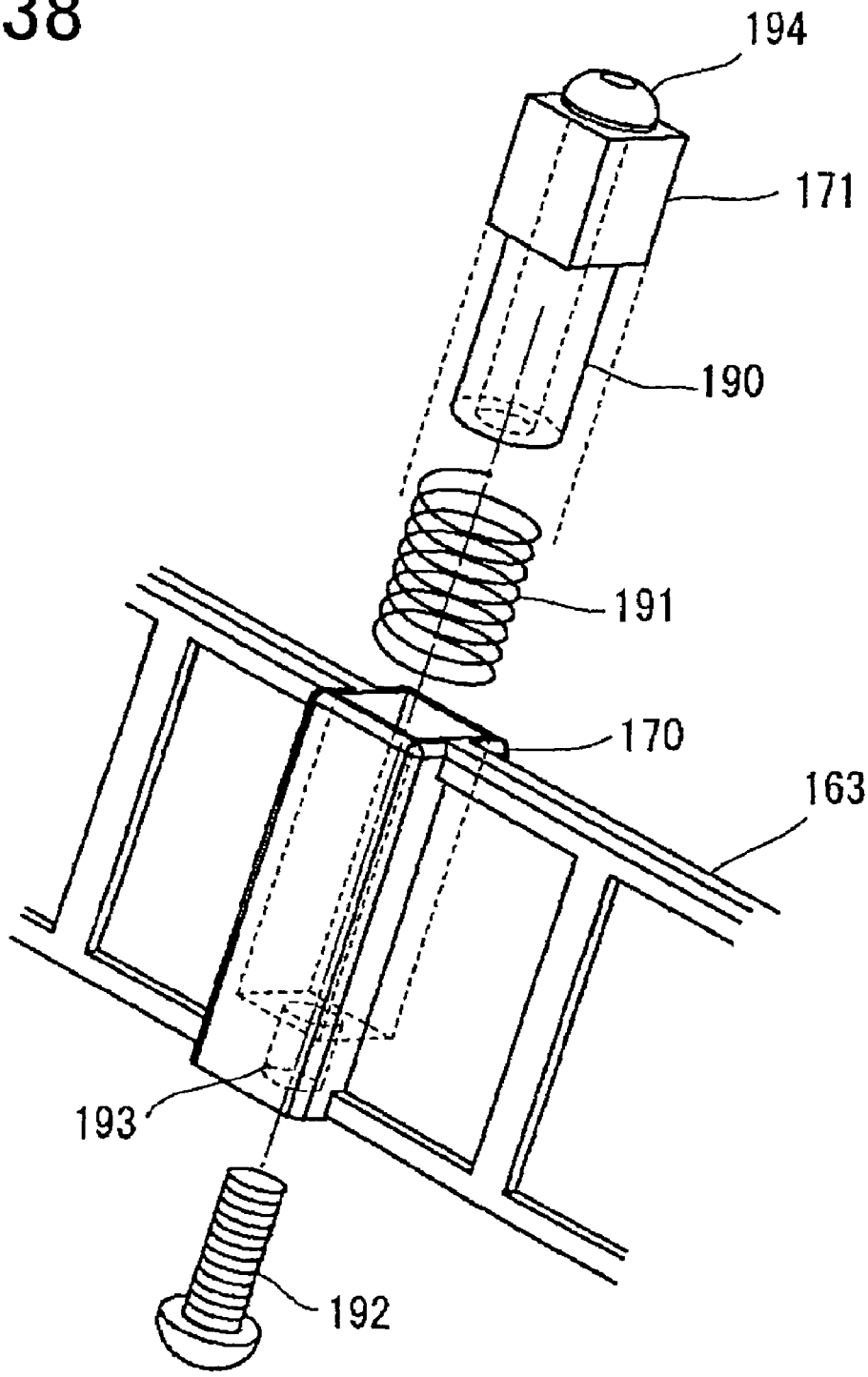
FIG. 38 is an exploded perspective view of a working part.
Figure 39:
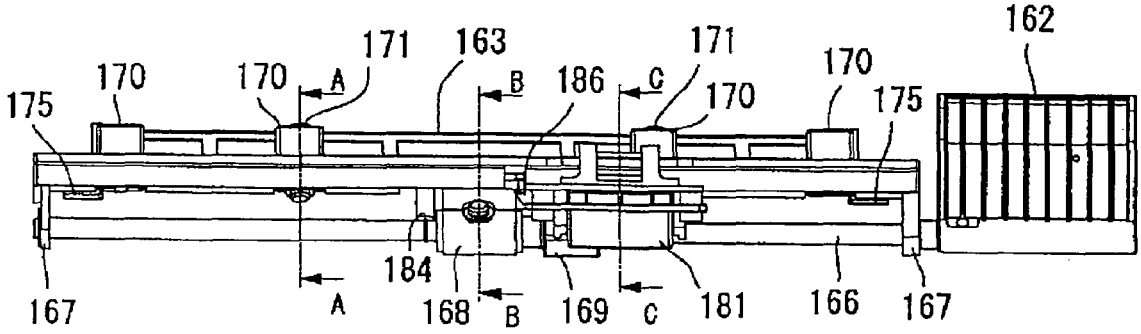
FIG. 39 is a side view showing an operating state of the pressing mechanism.
Figure 40A:
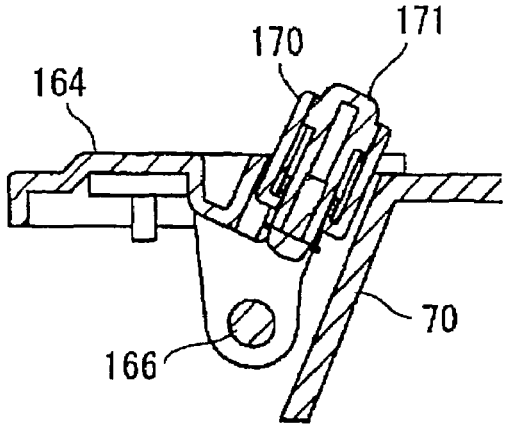
FIG. 40A is a cross-sectional view taken on line A—A of FIG. 39.
Figure 40B:
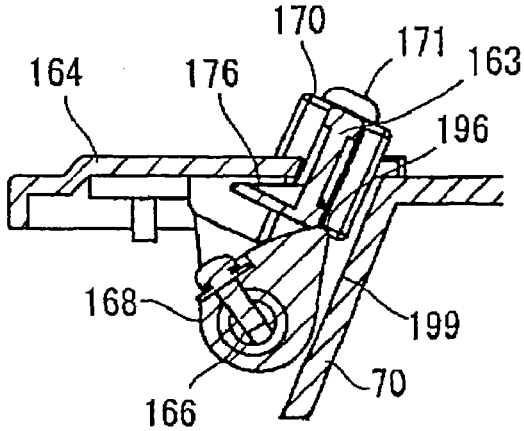
FIG. 40B is a cross-sectional view taken on line B—B of FIG. 39.
Figure 40C:
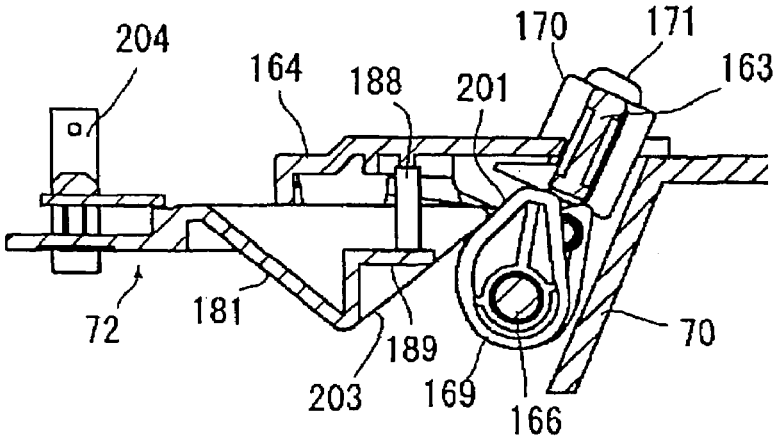
FIG. 40C is a cross-sectional view taken on line C—C of FIG. 39.

FIG. 36 is a side view of the pressing mechanism 71 at the standby state shown in FIG. 34 viewed from the opposite side of the photoconductive drum 25. FIG. 37A is a cross-sectional view taken on line A—A of FIG. 36. FIG. 37B is a cross-sectional view taken on line B—B of FIG. 36. FIG. 37C is a cross-sectional view taken on line C—C of FIG. 36. As shown in FIG. 36, the pressing plate 163 is urged downward by the coil spring 184, and the bottom surfaces of the regulatory protrusions 175 make contact with the actuating rotational shaft 166. FIG. 38 is an exploded perspective view of the holder 170. FIG. 39 is a side view of the pressing mechanism 71 at the operation state shown in FIG. 33 viewed from the opposite side of the photoconductive drum 25. FIG. 40A is a cross-sectional view taken on line A—A of FIG. 39. FIG. 40B is a cross-sectional view taken on line B—B of FIG. 39. FIG. 40C is a cross-sectional view taken on line C—C of FIG. 39.

As shown in FIG. 38, a cylinder 190 having a small diameter is formed on the acting member 171 at a part to be accommodated inside the holder 170. A coil spring 191 is attached on an outer circumference of the cylinder 190. The coil spring 191 is sandwiched between the inner bottom surface of the holder 170 and the upper prism part of the cylinder 190 of the acting member 171. Therefore, the coil spring 191 works to urge the acting member 171 upward at all times. A hole 193 is formed through the bottom surface of the holder 170. A screw 192 is inserted through the hole 193, screwed together into the cylinder 190 of the acting member 171 and fixed. Therefore, as shown in FIG. 37A, the head of the screw 192 is engaged with the bottom surface of the holder 170. Thus, the acting member 171 is held inside the holder 170 against the urging force of the coil spring 191. As shown in FIG. 40A, under a state in which the acting member 171 is pressing the bottom surface of the developing unit 22, the acting member 171 is pushed into the holder 170 and the head of the screw 192 protrudes downward. Accordingly, the bottom surface of the developing unit 22 is pressed and held by an elastic force of the coil spring 191. By changing the length of the screw 192 to be screwed into the cylinder 190, the urging force of the coil spring 192 can be changed. Therefore, when pressing the bottom surface of the developing unit 22 by the acting member 171, the pressing force can be adjusted by the length of the screwed in screw 192. Since the pressing force can be adjusted independently for each of the acting members 171 by the screw 192, for example, after inserting the developing unit 22, while confirming the contacting state between the photoconductive drum 25 and the developing roller 55, the pressing force can be adjusted finely.

A hemispheric contact portion 194 is formed on the upper surface of each of the acting members 171. Meanwhile, as shown in FIG. 19, cross-shaped contact ribs 195 are formed at positions corresponding to the contact portions 194 on the bottom surface of the developing unit 22. The center of the contact rib 195 is set to be located at approximately the center of the contact portion 194 when the developing unit 22 is inserted into the main frame 70. The hemispheric contact portions 194 press the center of the cross-shaped contact ribs 195. Accordingly, the pressing movement under the point contact state is carried out and the contact ribs 195 can be pressed in the direction of the arrow of FIG. 2 along the straight line 154. When assuming a flat surface including the rotational center shaft 152 of the photoconductive drum 25 and the rotational center shaft 153 of the developing roller 55, the contact points of the contact portions 194 and the contact ribs 195 are arranged at approximately the same interval from the flat surface and set to be provided along the flat surface. In addition, since the contact ribs 195 are formed on the bottom surface of the developing unit 22, the strength of the developing unit 22 is improved. As a result, the developing unit 22 is not deformed by the pressing movement.

As shown in FIG. 37B, the cam member 168 includes two slanting surfaces 197 and 198 formed so as to be widened from a summit 196 toward the actuating rotational shaft 166. The slanting surface 197 located on the opposite side of the photoconductive drum 25 bulges outward. The slanting surface 198 located closer to the photoconductive drum 25 is approximately a flat shape. The cam member 168 is urged by the coil spring 186 to be rotated counterclockwise (in FIG. 36, in a direction toward the front side from the page). Under the standby state of the pressing mechanism 71, as shown in FIG. 37B, the summit 196 is located on the opposite side of the photoconductive drum 25 with respect to the actuating rotational shaft 166. The pressing plate 163 is urged downward by the coil spring 184. The cam receiver 176 makes contact with the slanting surface 198 and stopped.

When the operation unit 162 rotates clockwise manually, the actuating rotational shaft 166 also rotates in the same manner. Therefore, the cam member 168 fixed on the actuating rotational shaft 166 rotates clockwise. The cam member 168 rotates from the state shown in FIG. 37B to the state shown in FIG. 40B. Then, as shown in FIG. 40B, the cam member 168 rotates so that the summit 196 pushes the cam receiver 176 upward. Therefore, the pressing plate 163 moves upward. In this case, the pressing plate 163 moves along a guide surface 199 formed on the main frame 70. The guide surface 199 is formed along the above-mentioned straight line 154. The summit 196 pushes up the cam receiver 176 while sliding against the cam receiver 176 by the rotation of the cam member 168. When the summit 196 is swung to the pressing plate 163 at the side of the photoconductive drum 25, as shown in FIG. 40B, the summit 196 is moved from the edge of the cam receiver 176 to be positioned between the pressing plate 163 and the guide surface 199. At an instant when the summit 196 departs from the edge of the cam receiver 176, the pressing plate 163 sinks slightly by gravity and the pulling force of the coil spring 184. A collision by the movement of the pressing plate 163 (a fluctuation in the load during the rotation by the urging force of the coil spring 184) is transmitted from the actuating rotational shaft 166 to the operation unit 162. Accordingly, an operator is notified that the pressing mechanism 71 has been set at the operational position. When the summit 196 is positioned between the pressing plate 163 and the guide surface 199, the cam member 168 is maintained at the operational position.

As shown in FIG. 37C, the cam member 169 includes two slanting surfaces 201 and 202 formed so as to be widened from a summit 200 toward the actuating rotational shaft 166. The slanting surface 201 located on the opposite side of the photoconductive drum 25 is formed to bulge outward. The slanting surface 202 located closer to the photoconductive drum 25 is approximately a flat shape. Under the standby state shown in FIG. 36, the summit 200 makes contact with a sliding surface 203 formed on the lower surface of the attaching portion 181 of the remaining toner detecting sensor 72. Under this state, the attaching portion 181 is urged downward by the compression spring 188 and pressed against the summit 200. However, since the cam member 169 is fixed to the actuating rotational shaft 166 and as described above, the cam member 168 makes contact with the cam receiver 176 by the coil spring 186 and is stopped. The cam member 169 is also stopped. Therefore, since a sensor part 204 of the remaining toner detecting sensor 72 is maintained under a state receded downward, the sensor part 204 can be prevented from making contact with the bottom surface of the developing unit 22 when inserting the developing unit 22.

Under the state shown in FIG. 40C, the cam member 169 rotates clockwise, the summit 200 departs from the sliding surface 203 and the slanting surface 201 makes contact with the sliding surface 203. Under this state, the attaching portion 181 moves downward, the remaining toner detecting sensor 72 rotates clockwise in FIGS. 40A–40C and the sensor part 204 moves upward. As shown in FIG. 2, when the sensor part 204 moves upward, the remaining toner detecting sensor 72 is set in the concave groove 73 provided on the bottom surface of the replenish chamber of the developing unit 22. As shown in FIG. 19, two concave grooves 73 are provided at both sides of a remaining amount detecting unit 205. The concave grooves 73 and the remaining amount detecting unit 205 are formed integrally by a transparent member made of synthetic resin. As shown in FIG. 2, the remaining amount detecting unit 205 having a prescribed groove width is formed along a rotational track of a cleaning member 206 mounted on the paddle 61. The toner in the remaining amount detecting unit 205 is discharged once to the outside of the remaining amount detecting unit 205 each time the cleaning member 206 slides inside the remaining amount detecting unit 205.

Figure 41:
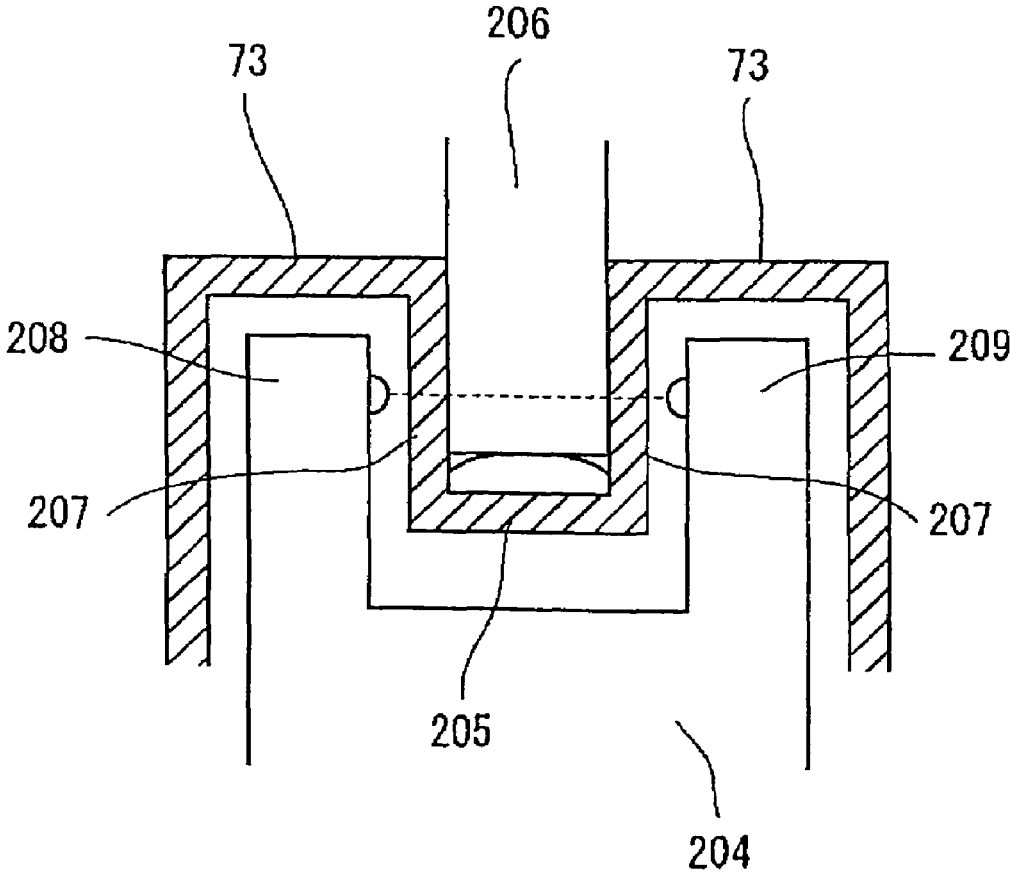
FIG. 41 is an explanatory drawing relating to a detection operation of a remaining toner detecting sensor.

FIG. 41 is a cross-sectional view showing a state in which the sensor part 204 is set in the concave groove 73 and the cleaning member 206 cleans inside the remaining amount detecting unit 205, viewed from a direction orthogonal to a direction in which the cleaning member 206 proceeds. The cleaning member 206 is formed of a plurality of rectangular rubber sheets stacked one on the other. The width of each sheet is slightly larger than the groove width of the remaining amount detecting unit 205. The rubber sheets are mounted on surfaces orthogonal to the direction in which the cleaning member 206 proceeds. Therefore, the sheets of the cleaning member 206 slide against both sides 207 of the remaining amount detecting unit 205 at all times and the toner is removed once. Meanwhile, a light emitter is fixed on a protrusion 208 of the sensor part 204 set in one of the concave grooves 73. A light receiver is fixed on a protrusion 209 of the sensor part 204 set in the other concave groove 73. The light receiver outputs a detection signal according to whether or not the light receiver received the light from the light emitter that penetrated through the remaining amount detecting unit 205.

Each time the cleaning member 206 slides inside the remaining amount detecting unit 205 in synchronism with the rotation of the paddle 61, the light from the light emitter penetrates through both sides 207 of the remaining amount detecting unit 205 and the light receiver outputs the detection signal. When a sufficient amount of toner has accumulated in the replenish chamber, after the cleaning member 206 slides, the inner side of the remaining amount detecting unit 205 is filled in with the toner again. Therefore, the light receiver does not detect the light. However, when the remaining amount of the toner in the replenish chamber becomes small, the inner side of the remaining amount detecting unit 205 cannot be filled in with the toner. Accordingly, the light receiver continues to detect the light. In accordance with such a change in the detection signal, the remaining toner detecting sensor 72 transmits to a control unit of the image forming device, a remaining amount detection signal indicating that the remaining amount of toner has become small.

(Other Safety Mechanism)

As shown in FIG. 33 and FIG. 34, by rotating the operation unit 162 clockwise from the standby position to the operational position, the pressing mechanism 71 presses the bottom surface of the developing unit 22. The developing roller 55 makes contact with the photoconductive drum 25, and the developing unit 22 is positioned. Therefore, if the pressing movement is carried out under a state in which the developing unit 22 is not inserted completely, or if the operation unit 162 is not set properly at the operational position, the developing unit 22 is not positioned properly, and the image forming process cannot be carried out normally. However, since a human being inserts the developing unit 22 and operates the operation unit 162, an incomplete setting or forgetting to set cannot be avoided. Therefore, in the present embodiment, a safety mechanism is provided so that the operator can easily confirm whether the developing unit 22 has been set properly.

Figure 42:
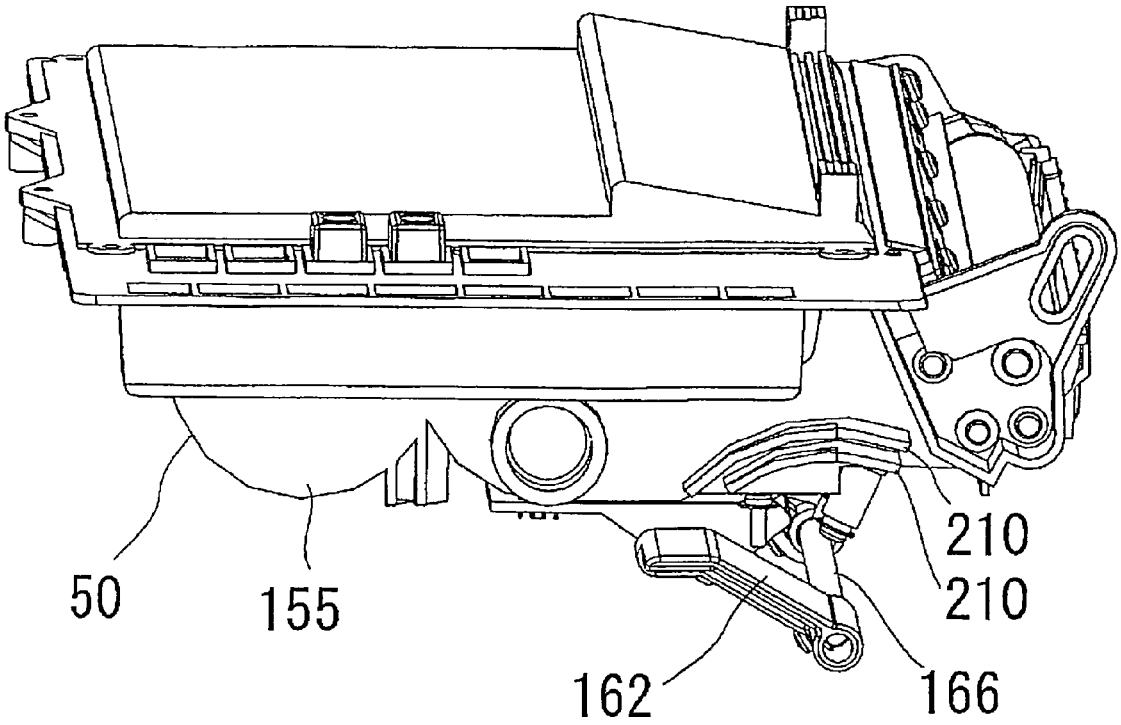
FIG. 42 is a perspective view of the developing unit and an operation unit under the standby state viewed from the front side.
Figure 44A:
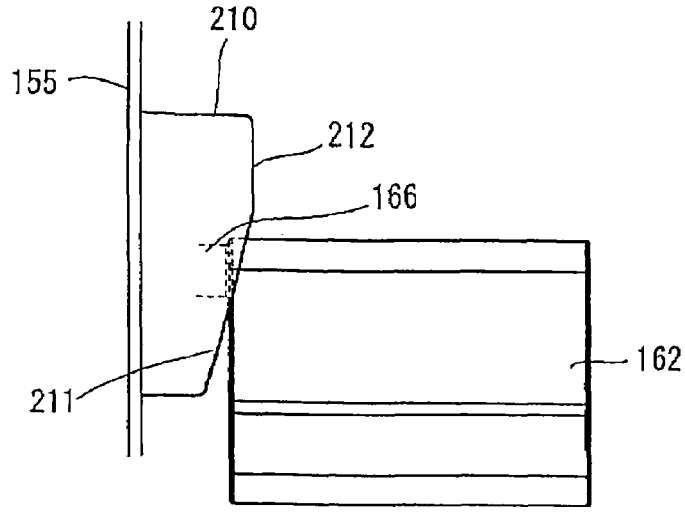
FIG. 44A through FIG. 44C are explanatory drawings showing a relationship between a protrusion and the operation unit.
Figure 44B:
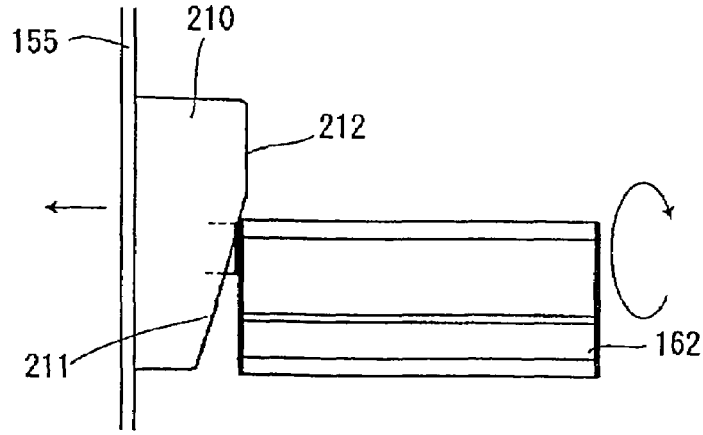
Figure 44C:
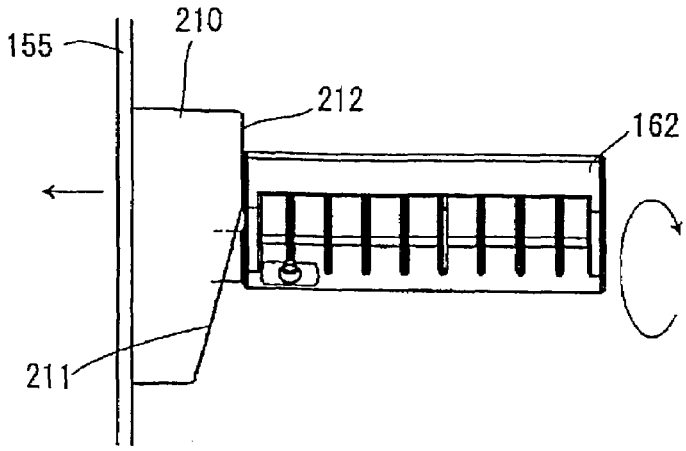

First, to prevent the developing unit 22 from being pressed by the pressing mechanism 71 under a state in which the developing unit 22 is inserted incompletely, as shown in FIG. 42, arc-shaped protrusions 210 are formed on the front frame 155 of the developing unit 22. FIG. 42 is a perspective view showing a state in which the operation unit 162 is located at the standby position as in FIG. 34. FIG. 44A is an enlarged plane view showing a part relating to the protrusion 210 of FIG. 42. As shown in the drawings, the arc-shaped protrusions 210 are formed in an arc-shape with the rotational center of the actuating rotational shaft 166 on which the operation unit 162 is fixed as the center. The protrusions 210 protrude in a plate-shape toward the operation unit 162. As shown in FIGS. 44A through 44C, the width of the protrusions 210 is set to widen gradually along a direction from the standby position of the operation unit 162 toward the operational position. A slanting surface 211 is formed on the side of the protrusion 210 with respect to the operational direction of the operation unit 162. A set surface 212 is set at the maximum width of the protrusion 210. An interval between the set surface 212 and the front frame 155 of the developing unit 22 is set to be approximately the same as an interval between the operation unit 162 set at the operational position and the front frame 155. Two protrusions 210 are provided and each is formed concentric, respectively.

When the operation unit 162 rotates clockwise from the standby position manually, if the developing unit 22 is not inserted properly in the main frame 70, the protrusions 210 are displaced to the front side. Therefore, as shown in FIG. 44B, the side surface of the operation unit 162 located on the developing unit 22 makes contact with the slanting surface 211. Since the operation unit 162 is fixed on the actuating rotational shaft 166 and does not move in the axial direction, the protrusions 210 are pushed in the inserting direction of the developing unit 22. Therefore, the developing unit 22 moves in the inserting direction in accordance with the swinging movement of the operation unit 162.

Figure 43:
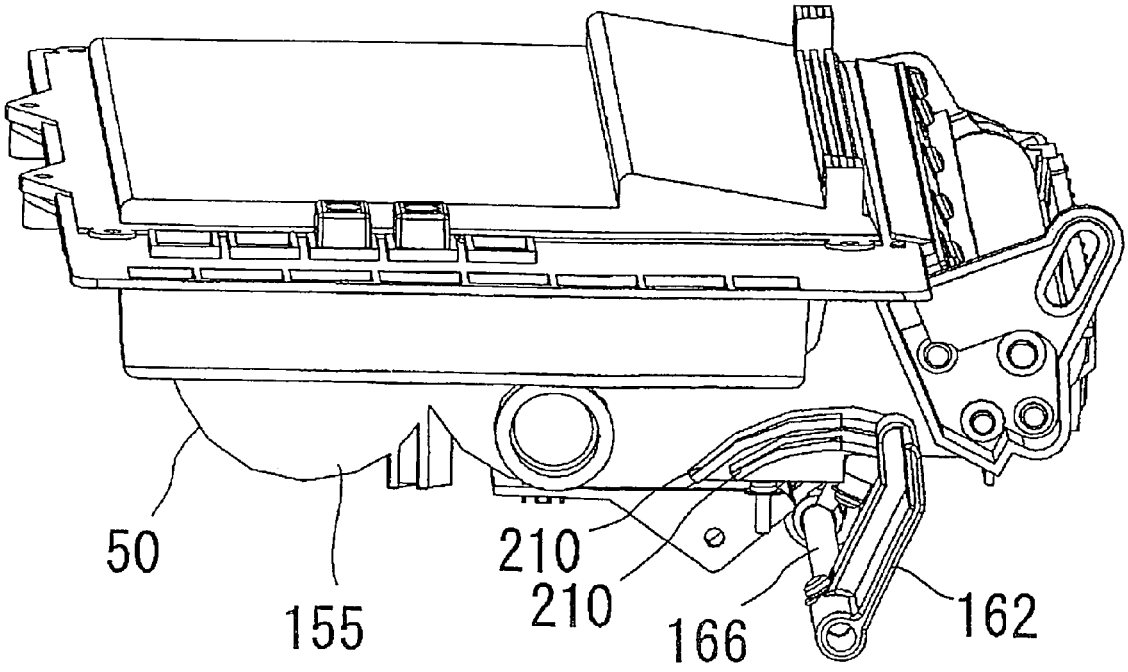
FIG. 43 is a perspective view of the developing unit and the operation unit under the operating state viewed from the front side.

FIG. 43 is a perspective view showing a state in which the operation unit 162 is set at the operational position. FIG. 44C is an enlarge plane view showing a part relating to the protrusions 210. As shown in the drawings, the set surface 212 of the protrusion 210 having the maximum width makes contact with the side surface of the operation unit 162. Therefore, under a state in which the inserting position of the developing unit 22 is set at a proper position, the pressing operation by the pressing mechanism 71 is carried out. Moreover, since a load is applied to the operation unit 162 when the operation unit 162 makes contact with the set surface 212, the operator can easily confirm that the developing unit 22 has been set at the proper position.

Figure 45:
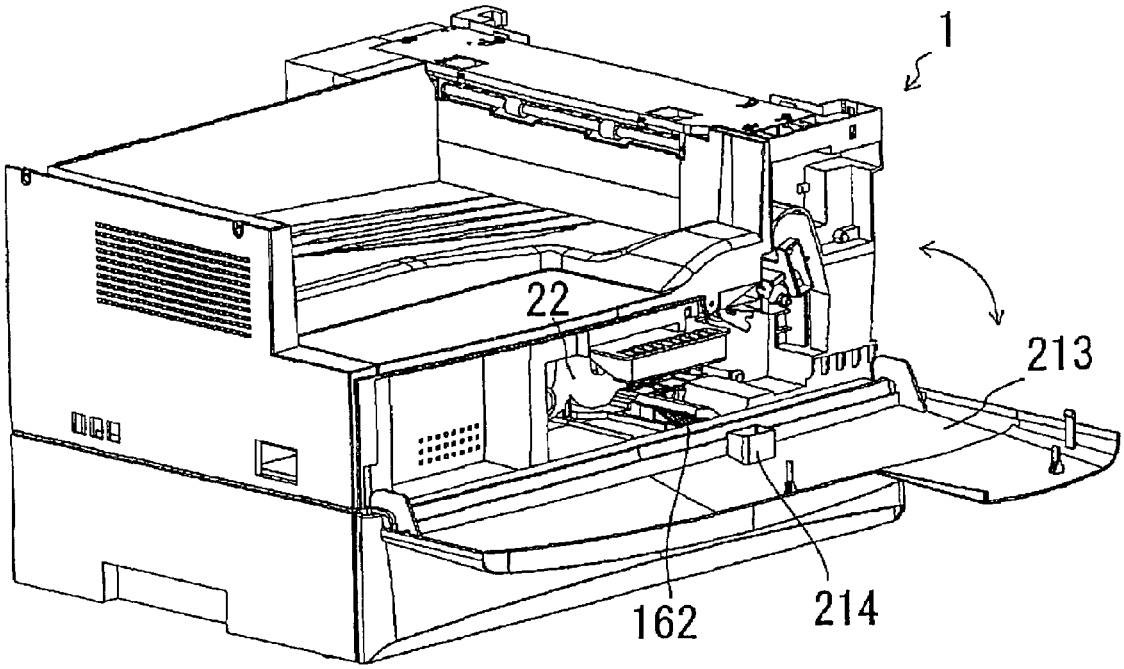
FIG. 45 is a perspective view showing the entire image forming device under a state in which a main cover is opened.

Next, a description will be made of a mechanism for preventing the operation unit 162 from not being set to a proper operational position or the operation unit 162 being forgotten to be set. FIG. 45 is a perspective view showing the entire image forming device 1 under a state in which a main cover 213 is opened. Both lower end parts of the main cover 213 are supported by the image forming device 1. The main cover 213 can be opened so as to fall on the front side. When inserting or removing the developing unit 22, first, the main cover 213 is opened. Then, the developing unit 22 is inserted or removed in a manner as described above. Subsequently, the main cover 213 is closed.

A regulatory protrusion 214 protrudes on an inner surface of the main cover 213. The regulatory protrusion 214 is rectangular in its cross-section and formed cylindrical. The regulatory protrusion 214 has a height protruding into a passing range where the operation unit 162 moves from the standby position to the operational position under a state in which the main cover 213 is closed. Therefore, when closing the main cover 213, if the regulatory protrusion 214 makes contact with the operation unit 162, the main cover 213 cannot be closed.

Figure 46:
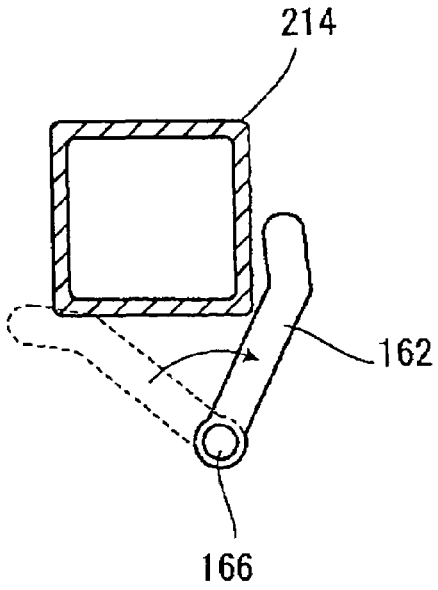
FIG. 46 is an explanatory drawing showing a positional relationship between a regulatory projection and the operation unit.

FIG. 46 shows the regulatory protrusion 214 viewed from the front side under a state in which the main cover 213 is closed. The operation unit 162 can swing from the standby position shown with the dashed lines to the operational position show with the solid lines. Under a state in which the operation unit 162 is set to the operational position, the regulatory protrusion 214 is positioned to be located at the standby position of the operation unit 162. A surface of the regulatory protrusion 214 facing the operation unit 162 is located in proximity to the operation unit 162. Therefore, even when the operation unit 162 is displaced slightly from the operational position, the regulatory protrusion 214 collides with the operation unit 162 and the main cover 213 cannot be closed. The width of the regulatory protrusion 214 in the operational direction of the operation unit 162 is set wide so as to cover the standby position of the operation unit 162. Therefore, even when the operation of the operation unit 162 is forgotten and the operation unit 162 is still located at the standby position, the regulatory protrusion 214 collides with the operation unit 162 and the main cover 213 cannot be closed.

As described above, if the operation unit 162 is not set at the operational position properly, the main cover 213 cannot be closed. Therefore, the operator can easily confirm that the developing unit 22 is not inserted properly.

What is claimed is:

1. A developing unit, comprising:

an impressed member to which a voltage is impressed;

a contact member made of a metal wire rod and urged by an elastic force to make contact with the impressed member and to be connected electrically with the impressed member; and a supporting plate member which supports the contact member at an inner surface side and exposes a part of the contact member as a contact part for an outer connection to an outer surface from an attaching hole, wherein a groove is formed along the contact member on the inner surface of the supporting plate member, and the contact member is fit in the groove.

2. The developing unit according to claim 1, wherein the contact member is pressed by the impressed member and the elastic force is applied.

3. The developing unit according to claim 2, wherein one end part of the contact member is formed in a coil spring shape and by pressing the one end part against the impressed member, the elastic force is applied to the contact member.

4. A developing unit comprising:

an impressed member to which a voltage is impressed;

a contact member made of a metal wire rod and urged by an elastic force to make contact with the impressed member and to be connected electrically with the impressed member;

a supporting plate member which supports the contact member at an inner surface side and exposes a part of the contact member as a contact part for an outer connection to an outer surface from an attaching hole;

a supply chamber which supplies a developer to an electrostatic latent image carrier on which a latent image is formed;

a replenish chamber which is provided laterally to the supply chamber and replenishes the developer in the supply chamber; and a partition wall which partitions the supply chamber and the replenish chamber, wherein the supply chamber includes a developer carrier which adheres the developer onto the electrostatic latent image carrier, and means for supplying the developer to the developer carrier;

a replenish opening is formed through the partition wall to regulate an amount of the developer replenished from the replenish chamber into the supply chamber; and the replenish chamber includes means for agitating and replenishing to replenish the developer from the replenish opening into the supply chamber by rotating at a prescribed rotational speed, and a plurality of means for agitating and transferring to transfer the developer toward the means for agitating and replenishing by rotating at a rotational speed slower than the rotational speed of the means for agitating and replenishing, wherein the plurality of the means for agitating and transferring are set to be rotated so that means for agitating and transferring located farther away from the means for agitating and replenishing is rotated at a slower rotational speed.

5. The developing unit according to claim 4, wherein the means for agitating and replenishing and the plurality of the means for agitating and transferring are disposed in parallel with one another in a lateral direction.

6. An image forming device, comprising:

a developing unit inserted removably and comprising:

an impressed member to which a voltage is impressed;

a contact member which is made of a metal wire rod and urged by an elastic force to make contact with the impressed member and to be connected electrically with the impressed member; and a supporting plate member which supports the contact member at an inner surface side and exposes a part of the contact member as a contact part for an outer connection to an outer surface from an attaching hole; and an electrode connected to the contact part and supplies the voltage, wherein a groove is formed along the contact member on the inner surface of the supporting plate member, and the contact member is fit in the groove.

7. The image forming device according to claim 6, wherein the contact member is pressed by the impressed member and the elastic force is applied.

8. The image forming device according to claim 7, wherein one end part of the contact member is formed in a coil spring shape and by pressing the one end part against the impressed member, the elastic force is applied to the contact member.

9. An image forming device comprising:

a developing unit inserted removably and comprising:

an impressed member to which a voltage is impressed;

a contact member which is made of a metal wire rod and urged by an elastic force to make contact with the impressed member and to be connected electrically with the impressed member;

a supporting plate member which supports the contact member at an inner surface side and exposes a part of the contact member as a contact part for an outer connection to an outer surface from an attaching hole; and an electrode connected to the contact part and supplies the voltage;

an electrostatic latent image carrier on which an electrostatic latent image is formed, wherein the developing unit includes a supply chamber which supplies a developer to the electrostatic latent image carrier, a replenish chamber which is provided laterally to the supply chamber and replenishes the developer to the supply chamber, and a partition wall which partitions the supply chamber and the replenish chamber, wherein the supply chamber includes a developer carrier which adheres the developer onto the electrostatic latent image carrier and means for supplying the developer to the developer carrier;

a replenish opening is formed through the partition wall to regulate an amount of the developer replenished from the replenish chamber into the supply chamber; and the replenish chamber includes means for agitating and replenishing to replenish the developer from the replenish opening into the supply chamber by rotating at a prescribed rotational speed, and a plurality of means for agitating and transferring to transfer the developer toward the means for agitating and replenishing by rotating at a rotational speed slower than the rotational speed of the means for agitating and replenishing, wherein the plurality of the means for agitating and transferring are set to be rotated so that means for agitating and transferring located farther away from the means for agitating and replenishing is rotated at a slower rotational speed.

10. The image forming device according to claim 9, wherein the means for agitating and replenishing and the plurality of the means for agitating and transferring are disposed in parallel with one another in a lateral direction.

* * * * *